US009677285B2

(12) United States Patent
Palsson et al.

(10) Patent No.: US 9,677,285 B2
(45) **Date of Patent: *Jun. 13, 2017**

(54) BUILDING PANELS

(71) Applicant: PERGO (EUROPE) AB, Trelleborg (SE)

(72) Inventors: Jorgen Palsson, Landskrona (SE); Ake Sjoberg, Lund (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/043,083

(22) Filed: Feb. 12, 2016

(65) Prior Publication Data

US 2016/0237697 A1 Aug. 18, 2016

Related U.S. Application Data

(60) Continuation of application No. 14/098,187, filed on Dec. 5, 2013, now Pat. No. 9,260,869, which is a (Continued)

(30) Foreign Application Priority Data

Mar. 31, 2000 (SE) ..... 0001149

(51) Int. Cl.
*E04B 2/00* (2006.01)
*E04F 15/02* (2006.01)
(Continued)

(52) U.S. Cl.
CPC ..... *E04F 15/02* (2013.01); *E04F 15/02038* (2013.01); *E04F 15/107* (2013.01);
(Continued)

(58) Field of Classification Search
CPC ..... E04F 15/02038; E04F 15/107
(Continued)

(56) References Cited

U.S. PATENT DOCUMENTS 87,853 A 3/1869 Kappes
108,068 A 10/1870 Utley
(Continued)

FOREIGN PATENT DOCUMENTS

AT 000 112 U2 2/1995
AT 002 214 U1 6/1998
(Continued)

OTHER PUBLICATIONS

Knight's American Mechanical Dictionary, vol. III. 1876, definition of "scarf".

(Continued)

*Primary Examiner* — Basil Katcheves
(74) *Attorney, Agent, or Firm* — Jenkins, Wilson, Taylor & Hunt, P.A.

(57) ABSTRACT

Flooring material comprising sheet-shaped floor elements with a mainly square or rectangular shape. The floor elements are provided with edges, a lower side and an upper decorative layer. The floor elements are intended to be joined by means of joining members. The floor elements are provided with male joining members on a first edge while a second edge of the floor elements are provided with a female joining member. The male joining member is provided with a tongue and a lower side groove while the female joining member is provided with a groove and a cheek, the cheek being provided with a lip. The floor elements are provided with a male vertical assembly joining member on a third edge while a fourth, opposite, edge is provided with female vertical assembly joining member.

11 Claims, 6 Drawing Sheets

Related U.S. Application Data continuation of application No. 13/860,315, filed on Apr. 10, 2013, now Pat. No. 9,316,006, which is a continuation of application No. 13/437,597, filed on Apr. 2, 2012, now Pat. No. 8,544,233, which is a continuation of application No. 12/240,739, filed on Sep. 29, 2008, now Pat. No. 8,146,318, which is a division of application No. 11/540,583, filed on Oct. 2, 2006, now Pat. No. 7,441,385, which is a continuation of application No. 10/286,982, filed on Nov. 4, 2002, now Pat. No. 7,121,058, which is a continuation-in-part of application No. 09/988,014, filed on Nov. 16, 2001, now abandoned, and a continuation-in-part of application No. 09/672,076, filed on Sep. 29, 2000, now Pat. No. 6,591,568, and a continuation-in-part of application No. 10/242,674, filed on Sep. 13, 2002, now Pat. No. 7,332,053.

(51) Int. Cl.
*E04F 15/10* (2006.01)
*E04F 15/04* (2006.01)

(52) U.S. Cl.
CPC ..... *E04F 15/04* (2013.01); *E04F 2201/0115* (2013.01); *E04F 2201/0138* (2013.01); *E04F 2201/0153* (2013.01); *E04F 2201/023* (2013.01); *E04F 2201/026* (2013.01); *E04F 2201/05* (2013.01); *E04F 2201/0517* (2013.01); *E04F 2201/0523* (2013.01)

(58) Field of Classification Search
USPC ..... 52/588.1, 581, 589.1, 592.2
See application file for complete search history.

(56) References Cited

U.S. PATENT DOCUMENTS 208,036 A 9/1878 Robley
213,740 A 4/1879 Conner
274,354 A 3/1883 McCarthy et al.
308,313 A 11/1884 Gerike
338,653 A 5/1886 Whitmore
342,529 A 5/1886 McRae
502,289 A 8/1893 Feldman
662,458 A 11/1900 Nagel
713,577 A 11/1902 Wickham
714,987 A 12/1902 Wolfe
752,694 A 2/1904 Lund
753,791 A 3/1904 Flughum
769,355 A 9/1904 Platow
832,003 A 9/1906 Torrence
847,272 A 3/1907 Ayers
877,639 A 1/1908 Galbraith
890,436 A 6/1908 Momberg
898,381 A 9/1908 Mattison
1,000,859 A 8/1911 Vaughan
1,002,102 A 8/1911 Weedon
1,016,383 A 2/1912 Wellman
1,078,776 A 11/1913 Dunton
1,097,986 A 5/1914 Moritz
1,124,226 A 1/1915 Houston
1,124,228 A 1/1915 Houston
1,137,197 A 4/1915 Ellis
1,140,958 A 5/1915 Cowan
1,201,285 A 10/1916 Gray
1,266,253 A 5/1918 Hakason
1,319,286 A 10/1919 Johnson et al.
1,357,713 A 11/1920 Lane
1,371,856 A 3/1921 Cade
1,407,679 A 2/1922 Ruchrauff
1,411,415 A 4/1922 Cooley
1,436,858 A 11/1922 Reinhart
1,454,250 A 5/1923 Parsons
1,468,288 A 9/1923 Fen
1,510,924 A 10/1924 Daniels et al.
1,540,128 A 6/1925 Houston
1,575,821 A 3/1926 Daniels
1,576,527 A 3/1926 McBride
1,576,821 A 3/1926 Daniels
1,602,256 A 10/1926 Sellin
1,602,267 A 10/1926 Karwisde
1,615,096 A 1/1927 Myers
1,622,103 A 3/1927 Fulton
1,622,104 A 3/1927 Fulton
1,637,634 A 8/1927 Carter
1,644,710 A 10/1927 Crooks
1,657,159 A 1/1928 Greenebaum
1,660,480 A 2/1928 Daniels
1,706,924 A 3/1929 Kane
1,714,738 A 5/1929 Smith
1,718,702 A 6/1929 Pfiester
1,723,306 A 8/1929 Sipe
1,734,826 A 11/1929 Pick
1,736,539 A 11/1929 Lachman
1,743,492 A 1/1930 Sipe
1,764,331 A 6/1930 Moratz
1,772,417 A 8/1930 Ellinwood
1,776,188 A 9/1930 Langbaum
1,823,039 A 9/1930 Gruner
1,778,069 A 10/1930 Fetz
1,787,027 A 12/1930 Wasleff
1,801,093 A 4/1931 Larkins
1,843,024 A 1/1932 Werner
1,854,396 A 4/1932 Davis
1,859,667 A 5/1932 Gruner
1,864,774 A 6/1932 Storm
1,477,813 A 12/1932 Daniels et al.
1,898,364 A 2/1933 Gynn
1,906,411 A 5/1933 Potvin
1,913,342 A 6/1933 Schaffert
1,929,871 A 10/1933 Jones
1,940,377 A 12/1933 Storm
1,946,646 A 2/1934 Storm
1,953,306 A 4/1934 Moratz
1,966,020 A 7/1934 Rowley
1,978,075 A 10/1934 Butterworth
1,986,739 A 1/1935 Mitte
1,988,201 A 1/1935 Hall
1,991,701 A 2/1935 Roman
2,004,193 A 6/1935 Cherry
2,015,813 A 10/1935 Nielsen
2,027,292 A 1/1936 Rockwell
2,044,216 A 6/1936 Klages
2,049,571 A 8/1936 Schuck
2,088,405 A 7/1937 Cahn
2,100,238 A 11/1937 Burgess
2,045,067 A 6/1938 Bruce
RE20,816 E 8/1938 Haase
2,126,956 A 8/1938 Gilbert
2,138,085 A 11/1938 Birtles
2,141,708 A 12/1938 Elmendorf
2,142,305 A 1/1939 Davis
2,194,086 A 3/1940 Horn
2,199,938 A 5/1940 Kloote
2,222,137 A 11/1940 Bruce
2,226,540 A 12/1940 Boettcher
2,238,169 A 4/1941 Heyn et al.
2,245,497 A 6/1941 Potchen
2,253,943 A 8/1941 Rice
2,261,897 A 11/1941 Adams
2,263,930 A 11/1941 Pasquier
2,266,464 A 12/1941 Kraft
2,276,071 A 3/1942 Scull
2,280,071 A 4/1942 Hamilton
2,282,559 A 5/1942 Byers
2,324,628 A 7/1943 Kahr
2,360,933 A 10/1944 Bunker
2,363,429 A 11/1944 Lowry
2,381,469 A 8/1945 Sweet
2,398,632 A 4/1946 Frost et al.
2,405,602 A 8/1946 Nugent
2,430,200 A 11/1947 Wilson

(56) References Cited

U.S. PATENT DOCUMENTS

| | | | |
|---|---|---|---|
| 2,411,364 | A | 5/1948 | Maynard |
| 2,487,571 | A | 11/1949 | Maxwell |
| 2,491,498 | A | 12/1949 | Kahr |
| 2,534,501 | A | 12/1950 | Coleman |
| 2,644,552 | A | 7/1953 | MacDonanld |
| 2,717,420 | A | 9/1955 | Georges |
| 2,729,584 | A | 1/1956 | Foster |
| 2,740,167 | A | 4/1956 | Rowley |
| 2,780,253 | A | 2/1957 | Joa |
| 2,805,852 | A | 9/1957 | Ewert |
| 2,808,624 | A | 10/1957 | Sullivan |
| 2,823,433 | A | 2/1958 | Kendall |
| 2,839,790 | A | 6/1958 | Collings |
| 2,857,302 | A | 10/1958 | Burton et al. |
| 2,863,185 | A | 12/1958 | Reidi |
| 2,865,058 | A | 12/1958 | Andersson et al. |
| 2,875,117 | A | 2/1959 | Potchen et al. |
| 2,878,530 | A | 3/1959 | Hilding |
| 2,894,292 | A | 7/1959 | Gramelspacher |
| 2,914,815 | A | 12/1959 | Alexander |
| 2,926,401 | A | 3/1960 | Place |
| 2,947,040 | A | 8/1960 | Schultz |
| 2,831,223 | A | 9/1960 | DeShazor |
| 2,952,341 | A | 9/1960 | Weiler |
| 2,974,692 | A | 3/1961 | Bolenbach |
| 2,996,751 | A | 8/1961 | Roby |
| 3,039,575 | A | 6/1962 | Graham |
| 3,040,388 | A | 6/1962 | Conn |
| 3,045,294 | A | 7/1962 | Livezey, Jr. |
| 3,090,082 | A | 5/1963 | Bauman |
| 3,100,556 | A | 8/1963 | Ridder |
| 3,125,138 | A | 3/1964 | Bolenbach |
| 3,128,851 | A | 4/1964 | Deridder et al. |
| 3,141,392 | A | 7/1964 | Schneider |
| 3,145,503 | A | 8/1964 | Brechin |
| 3,148,482 | A | 9/1964 | Neale |
| 3,162,906 | A | 12/1964 | Dudley |
| 3,172,508 | A | 3/1965 | Doering et al. |
| 3,174,411 | A | 3/1965 | Oestrich et al. |
| 3,175,476 | A | 3/1965 | Franks |
| 3,182,769 | A | 5/1965 | De Ridder |
| 3,192,574 | A | 7/1965 | Jaffe et al. |
| 3,199,258 | A | 8/1965 | Jentoft et al. |
| 3,200,553 | A | 8/1965 | Frashour et al. |
| 3,203,149 | A | 8/1965 | Soddy |
| 3,204,380 | A | 9/1965 | Wilson |
| 3,205,633 | A | 9/1965 | Nasbaum |
| 3,253,377 | A | 5/1966 | Schakel |
| 3,257,225 | A | 6/1966 | Marotta |
| 3,267,630 | A | 8/1966 | Omholt |
| 3,282,010 | A | 11/1966 | King, Jr. |
| 3,286,425 | A | 11/1966 | Brown |
| 3,296,056 | A | 1/1967 | Bechtold |
| 3,301,147 | A | 1/1967 | Clayton et al. |
| 3,310,919 | A | 3/1967 | Bue |
| 3,313,072 | A | 4/1967 | Cue |
| 3,331,171 | A | 7/1967 | Hallock |
| 3,331,176 | A | 7/1967 | Washam |
| 3,332,192 | A | 7/1967 | Kessler et al. |
| 3,339,329 | A | 9/1967 | Berg |
| 3,347,048 | A | 10/1967 | Brown et al. |
| 3,362,127 | A | 1/1968 | McGowan |
| 3,363,381 | A | 1/1968 | Forrest |
| 3,363,382 | A | 1/1968 | Forrest |
| 3,363,383 | A | 1/1968 | La Barge |
| 3,373,071 | A | 3/1968 | Fuerst |
| 3,377,931 | A | 4/1968 | Hilton |
| 3,385,182 | A | 5/1968 | Harvey |
| 3,387,422 | A | 6/1968 | Wanzer |
| 3,397,496 | A | 8/1968 | Sohns |
| 3,444,660 | A | 5/1969 | Feichter |
| 3,449,879 | A | 6/1969 | Bloom |
| 3,460,304 | A | 8/1969 | Braeuniger et al. |
| 3,473,278 | A | 10/1969 | Gossen |
| 3,474,584 | A | 10/1969 | Lynch |
| 3,479,784 | A | 11/1969 | Massagli |
| 3,481,810 | A | 12/1969 | Waite |
| 3,488,828 | A | 1/1970 | Gallagher |
| 3,496,119 | A | 2/1970 | Fitzgerald |
| 3,508,369 | A | 4/1970 | Tennison |
| 3,512,324 | A | 5/1970 | Reed |
| 3,526,420 | A | 9/1970 | Brancaleone |
| 3,535,844 | A | 10/1970 | Glaros |
| 3,538,665 | A | 11/1970 | Gohner |
| 3,538,819 | A | 11/1970 | Gould et al. |
| 3,548,559 | A | 12/1970 | Levine |
| 3,553,919 | A | 1/1971 | Omholt |
| 3,555,761 | A | 1/1971 | Rosebrough |
| 3,555,762 | A | 1/1971 | Costanzo, Jr. |
| 3,570,205 | A | 3/1971 | Payne |
| 3,572,224 | A | 3/1971 | Perry |
| 3,579,941 | A | 5/1971 | Tibbals |
| 3,605,368 | A | 9/1971 | Lalouche |
| 3,619,964 | A | 11/1971 | Passaro et al. |
| 3,627,362 | A | 12/1971 | Brenneman |
| 3,640,191 | A | 2/1972 | Hendrich |
| 3,657,852 | A | 4/1972 | Worthington et al. |
| 3,665,666 | A | 5/1972 | Delcroix |
| 3,667,153 | A | 6/1972 | Christiansen |
| 3,671,369 | A | 6/1972 | Kvalheim et al. |
| 3,673,751 | A | 7/1972 | Boassy et al. |
| 3,676,971 | A | 7/1972 | Dombroski |
| 3,679,531 | A | 7/1972 | Wienand et al. |
| 3,687,773 | A | 8/1972 | Wangborg |
| 3,694,983 | A | 10/1972 | Couquet |
| 3,696,575 | A | 10/1972 | Armstrong |
| 3,707,061 | A | 12/1972 | Collette et al. |
| 3,714,747 | A | 2/1973 | Curran |
| 3,720,027 | A | 3/1973 | Christensen |
| 3,731,445 | A | 5/1973 | Hoffmann et al. |
| 3,740,914 | A | 6/1973 | Arnaiz Diez |
| 3,742,672 | A | 7/1973 | Schaeufele |
| 3,745,726 | A | 7/1973 | Thom et al. |
| 3,758,650 | A | 9/1973 | Hurst |
| 3,759,007 | A | 9/1973 | Thiele |
| 3,760,544 | A | 9/1973 | Hawes et al. |
| 3,760,548 | A | 9/1973 | Sauer et al. |
| 3,761,338 | A | 9/1973 | Ungar et al. |
| 3,768,846 | A | 10/1973 | Hensley et al. |
| 3,778,958 | A | 12/1973 | Fowler |
| 3,780,469 | A | 12/1973 | Hancovsky |
| 3,786,608 | A | 1/1974 | Boettcher |
| 3,798,111 | A | 3/1974 | Lane et al. |
| 3,807,113 | A | 4/1974 | Turner |
| 3,808,030 | A | 4/1974 | Bell |
| 3,810,707 | A | 5/1974 | Tungseth et al. |
| 3,849,111 | A | 11/1974 | Kihlstedt |
| 3,849,240 | A | 11/1974 | Mikulak |
| 3,859,000 | A | 1/1975 | Webster |
| 3,883,258 | A | 5/1975 | Hewson |
| 3,884,008 | A | 5/1975 | Miller |
| 3,884,328 | A | 5/1975 | Williams |
| 3,902,291 | A | 9/1975 | Zucht |
| 3,902,293 | A | 9/1975 | Witt et al. |
| 3,908,053 | A | 9/1975 | Hettich |
| 3,908,062 | A | 9/1975 | Roberts |
| 3,921,312 | A | 11/1975 | Fuller |
| 3,924,496 | A | 12/1975 | DerMarderosian et al. |
| 3,936,551 | A | 2/1976 | Elmendorf et al. |
| 3,936,758 | A | 2/1976 | Kostelnicek et al. |
| 3,953,661 | A | 4/1976 | Gulley |
| 3,987,599 | A | 10/1976 | Hines |
| 3,988,187 | A | 10/1976 | Witt et al. |
| 4,021,087 | A | 5/1977 | Ferguson |
| 4,037,377 | A | 7/1977 | Howell et al. |
| 4,059,933 | A | 11/1977 | Funk et al. |
| 4,060,437 | A | 11/1977 | Strout |
| 4,065,902 | A | 1/1978 | Lindal |
| 4,067,155 | A | 1/1978 | Ruff et al. |
| 4,074,496 | A | 2/1978 | Fischer |
| 4,090,338 | A | 5/1978 | Bourgade |
| 4,094,090 | A | 6/1978 | Walmer |
| 4,095,913 | A | 6/1978 | Pettersson et al. |
| 4,099,358 | A | 7/1978 | Compaan |

(56) References Cited

U.S. PATENT DOCUMENTS 4,100,710 A 7/1978 Kowallik
4,143,498 A 3/1979 Martin et al.
4,144,689 A 3/1979 Bains
4,150,517 A 4/1979 Warner
4,156,048 A 5/1979 Davis
4,158,335 A 6/1979 Belcastro
4,164,832 A 8/1979 Van Zandt
4,165,305 A 8/1979 Sundie et al.
4,167,599 A 9/1979 Nissinen
4,169,688 A 10/1979 Toshio
4,182,072 A 1/1980 Much
4,186,539 A 2/1980 Harmon et al.
4,196,554 A 4/1980 Anderson et al.
4,198,455 A 4/1980 Spiro et al.
4,226,064 A 10/1980 Kraayenhof
4,242,390 A 12/1980 Nemeth
4,247,390 A 1/1981 Knoll
4,292,774 A 10/1981 Mairle
4,299,070 A 11/1981 Oltmanns et al.
4,304,083 A 12/1981 Anderson
4,316,351 A 2/1982 Ting
4,372,899 A 2/1983 Wiemann et al.
4,376,593 A 3/1983 Schaefer
4,390,580 A 6/1983 Donovan et al.
4,416,097 A 11/1983 Weir
4,426,820 A 1/1984 Terbrack et al.
4,435,935 A 3/1984 Larrea
4,449,346 A 5/1984 Tremblay
4,455,803 A 6/1984 Kornberger
4,461,131 A 7/1984 Pressell
4,471,012 A 9/1984 Maxwell
4,489,115 A 12/1984 Layman et al.
4,501,102 A 2/1985 Knowles
4,503,115 A 3/1985 Hemels et al.
4,504,347 A 3/1985 Munk et al.
4,505,887 A 3/1985 Miyata et al.
4,512,131 A 4/1985 Laramore
4,517,147 A 5/1985 Taylor et al.
4,520,062 A 5/1985 Ungar et al.
4,538,392 A 9/1985 Hamar et al.
4,561,233 A 12/1985 Harter et al.
4,571,910 A 2/1986 Cosentino
4,594,347 A 6/1986 Ishikawa et al.
4,599,124 A 7/1986 Kelly et al.
4,599,841 A 7/1986 Haid
4,599,842 A 7/1986 Counihan
4,612,745 A 9/1986 Hovde
4,621,471 A 11/1986 Kuhr et al.
4,640,437 A 2/1987 Weingartner
4,641,469 A 2/1987 Wood
4,643,237 A 2/1987 Rosa
4,646,494 A 3/1987 Saarinen et al.
4,653,138 A 3/1987 Carder
4,653,242 A 3/1987 Ezard
4,672,728 A 6/1987 Nimberger
4,683,631 A 8/1987 Dobbertin
4,703,597 A 11/1987 Eggemar
4,715,162 A 12/1987 Brightwell
4,724,187 A 2/1988 Ungar et al.
4,733,510 A 3/1988 Werner
4,736,563 A 4/1988 Bilhorn
4,738,071 A 4/1988 Ezard
4,741,136 A 5/1988 Thompson
4,747,197 A 5/1988 Charron
4,757,657 A 7/1988 Mitchell
4,757,658 A 7/1988 Kaempen
4,766,443 A 8/1988 Winegard et al.
4,769,963 A 9/1988 Meyerson
4,796,402 A 1/1989 Pajala
4,806,435 A 2/1989 Athey
4,819,532 A 4/1989 Benuzzi et al.
4,819,932 A 4/1989 Trotter, Jr.
4,831,806 A 5/1989 Niese et al.
4,833,855 A 5/1989 Winter
4,844,972 A 7/1989 Tedeschi et al.
4,845,907 A 7/1989 Meek
4,888,933 A 12/1989 Guomundsson et al.
4,893,449 A 1/1990 Kemper
4,894,272 A 1/1990 Aisley
4,905,442 A 3/1990 Daniels
4,906,484 A 3/1990 Lambuth et al.
4,910,280 A 3/1990 Robbins, III
4,917,532 A 4/1990 Haberhauer et al.
4,920,626 A 5/1990 Nimberger
4,940,503 A 7/1990 Lindgren et al.
4,952,775 A 8/1990 Yokoyama et al.
4,953,335 A 9/1990 Kawaguchi et al.
4,988,131 A 1/1991 Wilson et al.
4,998,395 A 3/1991 Bezner
4,998,396 A 3/1991 Palmersten
5,003,016 A 3/1991 Boeder
5,016,413 A 5/1991 Counihan
5,029,425 A 7/1991 Bogataj
5,034,272 A 7/1991 Lindgren et al.
5,050,362 A 9/1991 Tal et al.
5,052,158 A 10/1991 D'Luzansky
5,058,333 A 10/1991 Schwartz
5,070,662 A 12/1991 Niese
5,074,089 A 12/1991 Kemmer et al.
5,086,599 A 2/1992 Meyerson
5,092,095 A 3/1992 Zadok
5,102,253 A 4/1992 Pugliesi-Conti
5,109,898 A 5/1992 Schacht
5,113,632 A 5/1992 Hanson
5,117,603 A 6/1992 Weintraub
5,138,812 A 8/1992 Palmersten
5,148,850 A 9/1992 Urbanick
5,155,952 A 10/1992 Herwegh et al.
5,157,890 A 10/1992 Jines
5,165,816 A 11/1992 Parasin
5,179,811 A 1/1993 Walker et al.
5,179,812 A 1/1993 Hill
5,182,892 A 2/1993 Chase
5,215,802 A 6/1993 Kaars Sijpesteijn
5,216,861 A 6/1993 Meyerson
5,244,303 A 9/1993 Hair
5,247,773 A 9/1993 Weir
5,253,464 A 10/1993 Nilsen
5,259,162 A 11/1993 Nicholas
5,266,384 A 11/1993 O'Dell et al.
5,271,564 A 12/1993 Smith
5,274,979 A 1/1994 Tsai
5,283,102 A 2/1994 Sweet et al.
5,292,155 A 3/1994 Bell et al.
5,295,341 A 3/1994 Kajiwara
5,313,751 A 5/1994 Wittler
5,325,649 A 7/1994 Kajiwara
5,343,665 A 9/1994 Palmersten
5,344,700 A 9/1994 McGath et al.
5,348,778 A 9/1994 Knipp et al.
5,349,796 A 9/1994 Meyerson
5,359,817 A 11/1994 Fulton
5,365,713 A 11/1994 Nicholas et al.
5,390,457 A 2/1995 Sjolander
5,413,840 A 5/1995 Mizuno
5,424,118 A 6/1995 McLaughlin
5,425,302 A 6/1995 Levrai et al.
5,433,048 A 7/1995 Strasser
5,433,806 A 7/1995 Pasquali et al.
5,437,934 A 8/1995 Witt et al.
5,474,831 A 12/1995 Nystrom
5,497,589 A 3/1996 Porter
5,502,939 A 4/1996 Zadok et al.
5,526,857 A 6/1996 Forman
5,527,128 A 6/1996 Rope et al.
5,540,025 A 7/1996 Takehara et al.
D373,203 S 8/1996 Kornfalt
5,555,980 A 9/1996 Johnston et al.
5,566,519 A 10/1996 Almaraz-Miera
5,567,497 A 10/1996 Zegler et al.
5,570,554 A 11/1996 Searer
5,581,967 A 12/1996 Glatz
5,597,024 A 1/1997 Bolyard et al.
5,618,602 A 4/1997 Nelson

(56) References Cited

U.S. PATENT DOCUMENTS 5,618,612 A 4/1997 Gstrein
5,623,799 A 4/1997 Kowalski
5,630,304 A 5/1997 Austin
5,647,181 A 7/1997 Hunts
5,657,598 A 8/1997 Wilbs et al.
5,671,575 A 9/1997 Wu
5,685,117 A 11/1997 Nicholson
5,688,569 A 11/1997 Gilmore et al.
5,692,354 A 12/1997 Searer
5,695,875 A 12/1997 Larsson et al.
5,706,621 A 1/1998 Pervan
5,706,623 A 1/1998 Brown
5,719,239 A 2/1998 Mirous et al.
5,735,092 A 4/1998 Clayton et al.
5,736,227 A 4/1998 Sweet et al.
5,755,068 A 5/1998 Ormiston
5,765,808 A 6/1998 Butschbacher et al.
5,768,850 A 6/1998 Chen
5,791,114 A 8/1998 Mandel
5,797,237 A 8/1998 Finkell, Jr.
5,823,240 A 10/1998 Bolyard et al.
5,827,592 A 10/1998 Van Gulik et al.
5,853,520 A 12/1998 Rich et al.
5,860,267 A 1/1999 Pervan
D406,360 S 3/1999 Finkell, Jr.
5,888,017 A 3/1999 Corrie
5,894,701 A 4/1999 Delorme
5,904,019 A 5/1999 Kooij et al.
5,907,934 A 6/1999 Austin
5,930,947 A 8/1999 Eckhoff
5,931,447 A 8/1999 Butschbacher et al.
5,935,668 A 8/1999 Smith
5,937,612 A 8/1999 Winer et al.
5,941,047 A 8/1999 Johansson
5,943,239 A 8/1999 Shamblin et al.
5,945,181 A 8/1999 Fisher
5,950,389 A 9/1999 Porter
5,968,625 A 10/1999 Hudson
5,971,655 A 10/1999 Shirakawa
5,987,839 A 11/1999 Hamar et al.
5,987,845 A 11/1999 Laronde
5,996,301 A 12/1999 Conterno
6,006,486 A 12/1999 Moriau et al.
6,012,263 A 1/2000 Church et al.
6,021,615 A 2/2000 Brown
6,021,646 A 2/2000 Burley
6,023,907 A 2/2000 Pervan
6,029,416 A 2/2000 Andersson
6,079,182 A 6/2000 Ellenberger
6,094,882 A 8/2000 Pervan
6,098,365 A 8/2000 Martin et al.
6,101,778 A 8/2000 Martensson
6,106,654 A 8/2000 Velin et al.
6,119,423 A 9/2000 Costantino
6,122,879 A 9/2000 Montes
6,134,854 A 10/2000 Stanchfield
6,141,920 A 11/2000 Kemper
6,143,119 A 11/2000 Seidner
6,148,884 A 11/2000 Bolyard et al.
6,158,915 A 12/2000 Kise
6,164,031 A 12/2000 Counihan
6,182,410 B1 2/2001 Pervan
6,182,413 B1 2/2001 Magnusson
6,189,283 B1 2/2001 Bentley
6,205,639 B1 3/2001 Pervan
6,209,278 B1 4/2001 Tychsen
6,216,403 B1 4/2001 Belbeoc'h
6,216,409 B1 4/2001 Roy et al.
6,219,982 B1 4/2001 Eyring
6,230,385 B1 5/2001 Nelson
6,233,899 B1 5/2001 Mellert et al.
6,247,285 B1 6/2001 Moebus
6,253,514 B1 7/2001 Jobe et al.
6,271,156 B1 8/2001 Gleason et al.
6,314,701 B1 11/2001 Meyerson
6,321,499 B1 11/2001 Chuang
6,324,796 B1 12/2001 Heath
6,324,803 B1 12/2001 Pervan
6,324,809 B1 12/2001 Nelson
6,332,733 B1 12/2001 Hamberger et al.
6,345,480 B1 2/2002 Kemper
6,345,481 B1 2/2002 Nelson
6,346,861 B2 2/2002 Kim et al.
6,363,677 B1 4/2002 Chen et al.
6,363,678 B1 4/2002 Shuler
6,365,258 B1 4/2002 Alm
6,385,936 B1 5/2002 Schneider
6,397,547 B1 6/2002 Martensson
6,404,240 B1 6/2002 Hakkal et al.
6,418,683 B1 7/2002 Martensson et al.
6,421,970 B1 7/2002 Martensson et al.
6,423,257 B1 7/2002 Stobart
6,437,616 B1 8/2002 Antone et al.
6,438,919 B1 8/2002 Knauseder
6,446,405 B1 9/2002 Pervan
6,446,413 B1 9/2002 Gruber
6,449,918 B1 9/2002 Nelson
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,517,935 B1 2/2003 Kornfalt et al.
6,521,314 B2 2/2003 Tychsen
6,526,719 B2 3/2003 Pletzer et al.
6,532,709 B2 3/2003 Pervan
6,536,178 B1 3/2003 Palsson
6,546,691 B2 4/2003 Leopolder
6,550,205 B2 4/2003 Neuhofer
6,551,007 B2 4/2003 Lichtenberg et al.
6,588,165 B1 7/2003 Wright
6,588,166 B2 7/2003 Martensson et al.
6,591,568 B1 7/2003 Pålsson
6,601,359 B2 8/2003 Olofsson
6,606,834 B2 8/2003 Martensson et al.
6,617,009 B1 9/2003 Chen et al.
6,647,689 B2 11/2003 Pletzer et al.
6,647,690 B1 11/2003 Martensson
6,670,019 B2 12/2003 Andersson
6,672,030 B2 1/2004 Schulte
6,681,820 B2 1/2004 Olofsson
6,682,254 B1 1/2004 Olofsson
6,685,391 B1 2/2004 Gideon
6,711,869 B2 3/2004 Tychsem
6,729,091 B1 5/2004 Martensson
6,745,534 B2 6/2004 Kornfalt
6,763,643 B1 7/2004 Martensson
6,769,217 B2 8/2004 Nelson
6,769,219 B2 8/2004 Schwitte et al.
6,769,835 B2 8/2004 Stridsman
6,786,016 B1 9/2004 Wood
6,802,166 B1 10/2004 Gerhard
6,804,926 B1 10/2004 Eisermann
6,805,951 B2 10/2004 Kornfalt et al.
6,823,638 B2 11/2004 Stanchfield
6,851,237 B2 2/2005 Niese et al.
6,851,241 B2 2/2005 Pervan
6,854,235 B2 2/2005 Martensson
6,860,074 B2 3/2005 Stanchfield
6,862,857 B2 3/2005 Tychsen
6,865,855 B2 3/2005 Knauseder
6,880,305 B2 4/2005 Pervan et al.
6,880,307 B2 4/2005 Schwitte et al.
6,898,913 B2 5/2005 Pervan
6,918,220 B2 7/2005 Pervan
6,920,732 B2 7/2005 Martensson
6,922,964 B2 8/2005 Pervan
6,931,798 B1 8/2005 Pocai
6,966,161 B2 11/2005 Palsson et al.
RE38,950 E 1/2006 Maiers et al.
7,003,924 B2 2/2006 Kettler et al.
7,015,727 B2 3/2006 Balasubramanian
7,021,019 B2 4/2006 Knauseder
7,051,486 B2 5/2006 Pervan

(56) References Cited

U.S. PATENT DOCUMENTS

| | | | |
|---|---|---|---|
| 7,086,205 | B2 | 8/2006 | Pervan |
| 7,121,058 | B2 | 10/2006 | Palsson et al. |
| 7,121,059 | B2 | 10/2006 | Pervan |
| 7,131,242 | B2 | 11/2006 | Martensson |
| 7,146,772 | B2 | 12/2006 | Ralf |
| 7,152,507 | B2 | 12/2006 | Solari |
| 7,188,456 | B2 | 3/2007 | Knauseder |
| 7,210,272 | B2 | 5/2007 | Friday |
| 7,251,916 | B2 | 8/2007 | Konzelmann et al. |
| 7,332,053 | B2 | 2/2008 | Palsson et al. |
| 7,337,588 | B1 | 3/2008 | Moebus |
| 7,347,328 | B2 | 3/2008 | Hartwall |
| 7,377,081 | B2 | 5/2008 | Ruhdorfer |
| 7,398,628 | B2 | 7/2008 | Van Horne |
| 7,441,385 | B2 | 10/2008 | Palsson et al. |
| 7,444,791 | B1 | 11/2008 | Pervan |
| 7,451,578 | B2 | 11/2008 | Hannig |
| 7,484,337 | B2 | 2/2009 | Hecht |
| 7,497,058 | B2 | 3/2009 | Martensson |
| 7,552,568 | B2 | 6/2009 | Palsson et al. |
| 7,603,826 | B1 | 10/2009 | Moebus |
| 7,614,197 | B2 | 11/2009 | Nelson |
| 7,617,651 | B2 | 11/2009 | Grafenauer |
| 7,634,884 | B2 | 12/2009 | Pervan et al. |
| 7,637,068 | B2 | 12/2009 | Pervan |
| 7,665,267 | B2 | 2/2010 | Moriau et al. |
| 7,726,088 | B2 | 6/2010 | Muehlebach |
| 7,820,287 | B2 | 10/2010 | Kornfalt et al. |
| 7,841,144 | B2 | 11/2010 | Pervan |
| 7,856,784 | B2 | 12/2010 | Martensson |
| 7,856,785 | B2 | 12/2010 | Pervan |
| 7,856,789 | B2 | 12/2010 | Eisermann |
| 7,874,118 | B2 | 1/2011 | Schitter |
| 7,877,956 | B2 | 2/2011 | Martensson |
| 7,896,571 | B1 | 3/2011 | Hannig et al. |
| 7,980,039 | B2 | 7/2011 | Groeke et al. |
| 7,980,043 | B2 | 7/2011 | Moebus |
| 8,006,458 | B1 | 8/2011 | Olofsson et al. |
| 8,028,486 | B2 | 10/2011 | Pervan et al. |
| 8,037,657 | B2 | 10/2011 | Sjoberg et al. |
| 8,038,363 | B2 | 10/2011 | Hannig et al. |
| 8,117,795 | B2 | 2/2012 | Knauseder |
| 8,146,318 | B2 | 4/2012 | Palsson et al. |
| 8,234,834 | B2 | 8/2012 | Martensson et al. |
| 8,276,342 | B2 | 10/2012 | Martensson |
| 8,402,709 | B2 | 3/2013 | Martensson |
| 8,429,869 | B2 | 4/2013 | Pervan |
| 8,516,767 | B2 | 8/2013 | Engstrom |
| 8,544,233 | B2 | 10/2013 | Palsson |
| 8,578,675 | B2 | 11/2013 | Palsson |
| 8,615,952 | B2 | 12/2013 | Engstrom |
| 8,631,623 | B2 | 1/2014 | Engstrom |
| 8,661,762 | B2 | 3/2014 | Martensson et al. |
| 8,720,148 | B2 | 5/2014 | Engstrom |
| 8,789,334 | B2 | 7/2014 | Moriau et al. |
| 8,875,465 | B2 | 11/2014 | Mårtensson |
| 8,978,334 | B2 | 3/2015 | Engstrom |
| 9,032,685 | B2 | 5/2015 | Martensson et al. |
| 9,115,500 | B2 | 8/2015 | Engstrom |
| 9,140,009 | B2 | 9/2015 | Engstrom |
| 9,255,414 | B2 | 2/2016 | Palsson et al. |
| 9,260,869 | B2 | 2/2016 | Palsson et al. |
| 9,316,006 | B2 | 4/2016 | Palsson et al. |
| 9,322,162 | B2 | 4/2016 | Olofsson et al. |
| 9,410,327 | B2 | 8/2016 | Engstrom |
| 9,447,586 | B2 | 9/2016 | Engstrom |
| 9,464,443 | B2 | 10/2016 | Martensson |
| 9,464,444 | B2 | 10/2016 | Engstrom |
| 2001/0024707 | A1 | 9/2001 | Andersson et al. |
| 2001/0029720 | A1 | 10/2001 | Pervan |
| 2002/0007608 | A1 | 1/2002 | Pervan |
| 2002/0031646 | A1 | 3/2002 | Chen |
| 2002/0046526 | A1 | 4/2002 | Knauseder |
| 2002/0046528 | A1 | 4/2002 | Pervan et al. |
| 2002/0059762 | A1 | 5/2002 | Takeuchi et al. |
| 2002/0095895 | A1 | 7/2002 | Daly et al. |
| 2002/0100242 | A1 | 8/2002 | Olofsson |
| 2002/0112429 | A1 | 8/2002 | Niese et al. |
| 2002/0112433 | A1 | 8/2002 | Pervan |
| 2002/0127374 | A1 | 9/2002 | Spratling |
| 2002/0148551 | A1 | 10/2002 | Knauseder |
| 2002/0178674 | A1 | 12/2002 | Pervan |
| 2002/0178681 | A1 | 12/2002 | Zancai et al. |
| 2002/0178682 | A1 | 12/2002 | Pervan |
| 2002/0189183 | A1 | 12/2002 | Ricciardelli |
| 2002/0189747 | A1 | 12/2002 | Steinwender |
| 2003/0009971 | A1 | 1/2003 | Palmberg |
| 2003/0009972 | A1 | 1/2003 | Pervan et al. |
| 2003/0024199 | A1 | 2/2003 | Pervan et al. |
| 2003/0024200 | A1 | 2/2003 | Moriau et al. |
| 2003/0033784 | A1 | 2/2003 | Pervan |
| 2003/0037504 | A1 | 2/2003 | Schwitte et al. |
| 2003/0068447 | A1 | 4/2003 | Carling |
| 2003/0084634 | A1 | 5/2003 | Stanchfield |
| 2003/0084636 | A1 | 5/2003 | Pervan |
| 2003/0094230 | A1 | 5/2003 | Sjoberg |
| 2003/0112913 | A1 | 6/2003 | Balasubramanian |
| 2003/0118812 | A1 | 6/2003 | Kornfalt |
| 2003/0141004 | A1 | 7/2003 | Palmblad |
| 2003/0145540 | A1 | 8/2003 | Brunedal |
| 2003/0154678 | A1 | 8/2003 | Stanchfield |
| 2003/0159389 | A1 | 8/2003 | Kornfalt |
| 2003/0196975 | A1 | 10/2003 | Murray et al. |
| 2003/0224147 | A1 | 12/2003 | Maine et al. |
| 2004/0016197 | A1 | 1/2004 | Ruhdorfer |
| 2004/0031225 | A1 | 2/2004 | Fowler |
| 2004/0031226 | A1 | 2/2004 | Miller |
| 2004/0031227 | A1 | 2/2004 | Knauseder |
| 2004/0035077 | A1 | 2/2004 | Martensson et al. |
| 2004/0040235 | A1 | 3/2004 | Kurtz |
| 2004/0041225 | A1 | 3/2004 | Nemoto |
| 2004/0128934 | A1 | 7/2004 | Hecht |
| 2004/0139678 | A1 | 7/2004 | Pervan |
| 2004/0159066 | A1 | 8/2004 | Thiers et al. |
| 2004/0182036 | A1 | 9/2004 | Sjoberg et al. |
| 2004/0191461 | A1 | 9/2004 | Riccobene |
| 2004/0211143 | A1 | 10/2004 | Hanning |
| 2004/0211144 | A1 | 10/2004 | Stanchfield |
| 2004/0219339 | A1 | 11/2004 | Dempsey et al. |
| 2004/0250492 | A1 | 12/2004 | Becker |
| 2005/0034405 | A1 | 2/2005 | Pervan |
| 2005/0050827 | A1 | 3/2005 | Schitter |
| 2005/0144881 | A1 | 7/2005 | Tate |
| 2005/0166526 | A1 | 8/2005 | Stanchfield |
| 2005/0210810 | A1 | 9/2005 | Pervan |
| 2005/0252130 | A1 | 11/2005 | Martensson |
| 2006/0026923 | A1 | 2/2006 | Thiers et al. |
| 2006/0101769 | A1 | 5/2006 | Pervan |
| 2006/0236642 | A1 | 10/2006 | Pervan |
| 2006/0248836 | A1 | 11/2006 | Martensson |
| 2007/0006543 | A1 | 1/2007 | Engstrom |
| 2007/0028547 | A1 | 2/2007 | Grafenauer et al. |
| 2007/0240376 | A1 | 10/2007 | Engstrom |
| 2008/0000185 | A1 | 1/2008 | Duernberger |
| 2008/0000186 | A1 | 1/2008 | Pervan |
| 2008/0000187 | A1 | 1/2008 | Pervan |
| 2008/0134613 | A1 | 6/2008 | Pervan |
| 2008/0216434 | A1 | 9/2008 | Pervan |
| 2008/0236088 | A1 | 10/2008 | Hannig |
| 2008/0271403 | A1 | 11/2008 | Palsson |
| 2009/0019806 | A1 | 1/2009 | Muehlebach |
| 2009/0019808 | A1 | 1/2009 | Palsson et al. |
| 2009/0064624 | A1 | 3/2009 | Sokol |
| 2009/0100782 | A1 | 4/2009 | Groeke et al. |
| 2009/0193748 | A1 | 8/2009 | Boo et al. |
| 2009/0199500 | A1 | 8/2009 | LeBlang |
| 2009/0217615 | A1 | 9/2009 | Engstrom |
| 2009/0249733 | A1 | 10/2009 | Moebus |
| 2010/0031599 | A1 | 2/2010 | Kennedy et al. |
| 2010/0043333 | A1 | 2/2010 | Hannig |
| 2010/0058700 | A1 | 3/2010 | LeBlang |
| 2010/0236707 | A1 | 9/2010 | Studer et al. |
| 2011/0078977 | A1 | 4/2011 | Martensson et al. |
| 2011/0167751 | A1 | 7/2011 | Engstrom |

(56) References Cited

U.S. PATENT DOCUMENTS

| | | | |
|---|---|---|---|
| 2011/0173914 | A1 | 7/2011 | Engstrom |
| 2011/0185663 | A1 | 8/2011 | Martensson |
| 2011/0225922 | A1 | 9/2011 | Pervan et al. |
| 2011/0271631 | A1 | 11/2011 | Engstrom |
| 2011/0271632 | A1 | 11/2011 | Cappelle et al. |
| 2011/0293361 | A1 | 12/2011 | Olofsson |
| 2012/0042595 | A1 | 2/2012 | De Boe |
| 2012/0055112 | A1 | 3/2012 | Engstrom |
| 2012/0216472 | A1 | 8/2012 | Martensson et al. |
| 2012/0233948 | A1 | 9/2012 | Palsson |
| 2012/0247053 | A1 | 10/2012 | Martensson |
| 2012/0291396 | A1 | 11/2012 | Martensson |
| 2012/0304590 | A1 | 12/2012 | Engstrom |
| 2013/0042555 | A1 | 2/2013 | Martensson |
| 2013/0067840 | A1 | 3/2013 | Martensson |
| 2013/0241103 | A1 | 9/2013 | Engstrom |
| 2013/0291467 | A1 | 11/2013 | Palsson et al. |
| 2014/0033630 | A1 | 2/2014 | Engstrom |
| 2014/0137506 | A1 | 5/2014 | Palsson |
| 2014/0157700 | A1 | 6/2014 | Martensson |
| 2014/0157711 | A1 | 6/2014 | Palsson et al. |
| 2014/0157721 | A1 | 6/2014 | Engstrom |
| 2014/0165493 | A1 | 6/2014 | Palsson et al. |
| 2014/0283476 | A1 | 9/2014 | Engstrom |
| 2015/0075105 | A1 | 3/2015 | Engstrom |
| 2015/0184397 | A1 | 7/2015 | Engstrom |
| 2016/0040438 | A1 | 2/2016 | Engstrom |
| 2016/0069087 | A1 | 3/2016 | Engstrom |

FOREIGN PATENT DOCUMENTS

| | | | |
|---|---|---|---|
| AU | 1309883 | A | 10/1983 |
| AU | 199732569 | | 12/1999 |
| AU | 200020703 | | 6/2000 |
| BE | 417526 | A | 10/1936 |
| BE | 556860 | A | 5/1957 |
| BE | 557844 | A | 3/1960 |
| BE | 765817 | A2 | 9/1971 |
| BE | 1010487 | A6 | 10/1996 |
| BE | 1010339 | A3 | 6/1998 |
| CA | 991373 | A1 | 6/1976 |
| CA | 1049736 | A1 | 3/1979 |
| CA | 1169106 | A1 | 6/1984 |
| CA | 1325873 | C | 1/1994 |
| CA | 2226286 | A1 | 12/1997 |
| CA | 2252791 | C | 5/1999 |
| CA | 2162836 | C | 6/1999 |
| CA | 2289309 | A1 | 11/1999 |
| CA | 2150384 | C | 4/2005 |
| CH | 200949 | A | 11/1938 |
| CH | 211677 | A | 10/1940 |
| CH | 211877 | A | 10/1940 |
| CH | 562 377 | A5 | 5/1975 |
| CH | 640455 | A5 | 1/1984 |
| CN | 1054215 | A | 9/1991 |
| CN | 2091909 | U | 1/1992 |
| CN | 1115351 | A | 1/1996 |
| CN | 1124941 | A | 6/1996 |
| CN | 2242278 | Y | 12/1996 |
| DE | 209979 | C | 11/1906 |
| DE | 517353 | | 2/1931 |
| DE | 1212275 | B | 3/1966 |
| DE | 1934295 | U | 3/1966 |
| DE | 1985418 | U | 5/1968 |
| DE | 1534802 | A1 | 4/1970 |
| DE | 71 02 476 | | 6/1971 |
| DE | 1658875 | B1 | 9/1971 |
| DE | 2007129 | A1 | 9/1971 |
| DE | 1534278 | A1 | 11/1971 |
| DE | 2139283 | A1 | 2/1972 |
| DE | 2101782 | A1 | 7/1972 |
| DE | 2102537 | A1 | 8/1972 |
| DE | 2145024 | A1 | 3/1973 |
| DE | 2159042 | A1 | 6/1973 |
| DE | 2205232 | A1 | 8/1973 |
| DE | 2238660 | A1 | 2/1974 |
| DE | 74 02 354 | | 5/1974 |
| DE | 2251762 | | 5/1974 |
| DE | 2252643 | A1 | 5/1974 |
| DE | 2502992 | A1 | 7/1976 |
| DE | 2552622 | A1 | 5/1977 |
| DE | 2616077 | A1 | 10/1977 |
| DE | 2802151 | A1 | 7/1979 |
| DE | 2917025 | A1 | 11/1980 |
| DE | 2916482 | A1 | 12/1980 |
| DE | 2927425 | A1 | 1/1981 |
| DE | 3104519 | | 2/1981 |
| DE | 2940945 | A1 | 4/1981 |
| DE | 3041781 | A1 | 6/1982 |
| DE | 3046618 | A1 | 7/1982 |
| DE | 3117605 | A1 | 11/1982 |
| DE | 3214207 | | 11/1982 |
| DE | 3246376 | | 6/1984 |
| DE | 3304992 | | 8/1984 |
| DE | 3306609 | | 9/1984 |
| DE | 3319235 | | 11/1984 |
| DE | 3343601 | | 6/1985 |
| DE | 3412882 | A1 | 10/1985 |
| DE | 86 00 241 | U1 | 4/1986 |
| DE | 86 04 004 | | 4/1986 |
| DE | 3512204 | | 10/1986 |
| DE | 3544845 | | 6/1987 |
| DE | 3631390 | | 12/1987 |
| DE | 3640822 | | 6/1988 |
| DE | 3741041 | A1 | 9/1988 |
| DE | 3933611 | A1 | 4/1991 |
| DE | 4105207 | A1 | 8/1991 |
| DE | 40025470 | | 8/1991 |
| DE | 3932980 | | 11/1991 |
| DE | 93 00 306 | | 3/1993 |
| DE | 4130115 | A1 | 3/1993 |
| DE | 4134452 | | 4/1993 |
| DE | 4215273 | | 11/1993 |
| DE | 42 42 530 | | 6/1994 |
| DE | 43 44 089 | | 7/1994 |
| DE | 4313 037 | C1 | 8/1994 |
| DE | 9317191 | | 3/1995 |
| DE | 44 02 352 | A1 | 8/1995 |
| DE | 295 20 966 | U1 | 8/1996 |
| DE | 19503948 | A1 | 8/1996 |
| DE | 29614 086 | | 10/1996 |
| DE | 19601322 | A1 | 5/1997 |
| DE | 297 03 962 | | 6/1997 |
| DE | 29710175 | | 8/1997 |
| DE | 29711960 | | 10/1997 |
| DE | 19651149 | | 6/1998 |
| DE | 19704292 | A1 | 8/1998 |
| DE | 19709641 | | 9/1998 |
| DE | 19718319 | A1 | 11/1998 |
| DE | 19821938 | | 11/1999 |
| DE | 19851200 | C1 | 3/2000 |
| DE | 20001225 | | 7/2000 |
| DE | 19940837 | A1 | 11/2000 |
| DE | 19925248 | | 12/2000 |
| DE | 20018284 | | 1/2001 |
| DE | 19933343 | A1 | 2/2001 |
| DE | 20017461 | | 2/2001 |
| DE | 20027461 | | 3/2001 |
| DE | 19963203 | A1 | 9/2001 |
| DE | 100 01 076 | | 10/2001 |
| DE | 202 03 311 | U1 | 5/2002 |
| DE | 100 62 873 | | 7/2002 |
| DE | 202 06 751 | U1 | 8/2002 |
| DE | 101 20 062 | A1 | 11/2002 |
| DE | 101 31 248 | | 1/2003 |
| DE | 202 03 782 | | 7/2003 |
| DE | 102 12 324 | | 10/2003 |
| DE | 102 30 818 | B3 | 3/2004 |
| DE | 102 42 647 | A1 | 6/2004 |
| DE | 10 2004 055 951 | A1 | 7/2005 |
| DE | 10 2005 002 297.9 | | 8/2005 |
| DE | 10 2007 035 648 | | 1/2009 |
| DE | 2009 022 483.1 | | 5/2009 |
| DE | 20 2009 004 530 | | 6/2009 |

(56) References Cited

FOREIGN PATENT DOCUMENTS

| | | | |
|---|---|---|---|
| DE | 10 2010 020 089.1 | | 5/2010 |
| DE | 10 2009 022 483 | A1 | 12/2010 |
| DE | 10 2009 038 750 | | 3/2011 |
| DE | 10 2010 004717.1 | | 7/2011 |
| DE | 20 2004 021 867 | | 12/2011 |
| EP | 0 024 360 | A1 | 3/1981 |
| EP | 0 044 371 | A1 | 1/1982 |
| EP | 0 085 196 | | 8/1983 |
| EP | 0 117 707 | A2 | 9/1984 |
| EP | 0 161 233 | A1 | 11/1985 |
| EP | 0 196 672 | A2 | 10/1986 |
| EP | 0 220 389 | A2 | 5/1987 |
| EP | 0 248 127 | | 12/1987 |
| EP | 0 256 189 | A1 | 2/1988 |
| EP | 0 279 278 | A1 | 8/1988 |
| EP | 0 355 778 | A2 | 10/1989 |
| EP | 0 401 146 | A1 | 12/1990 |
| EP | 0 487 925 | A1 | 6/1992 |
| EP | 0 508 083 | A1 | 10/1992 |
| EP | 0 508 260 | A2 | 10/1992 |
| EP | 0 562 402 | A1 | 9/1993 |
| EP | 0 604 896 | A1 | 7/1994 |
| EP | 0 623 724 | | 11/1994 |
| EP | 0 652 332 | A1 | 5/1995 |
| EP | 0 652 340 | | 5/1995 |
| EP | 0 690 185 | A1 | 1/1996 |
| EP | 0 698 162 | | 2/1996 |
| EP | 0 711 886 | | 5/1996 |
| EP | 0 715 037 | A1 | 6/1996 |
| EP | 0 799 679 | A2 | 10/1997 |
| EP | 0 813 641 | A1 | 12/1997 |
| EP | 0 843 763 | | 5/1998 |
| EP | 0 849 416 | | 6/1998 |
| EP | 0 85 5482 | | 7/1998 |
| EP | 0 877 130 | | 11/1998 |
| EP | 0 903 451 | | 3/1999 |
| EP | 0 906 994 | A1 | 4/1999 |
| EP | 0 958 441 | | 11/1999 |
| EP | 0 969 163 | | 1/2000 |
| EP | 0 969 164 | | 1/2000 |
| EP | 0 974 713 | | 1/2000 |
| EP | 1 045 083 | A1 | 10/2000 |
| EP | 1 120 515 | A1 | 8/2001 |
| EP | 1 146 182 | A2 | 10/2001 |
| EP | 1 229 181 | | 8/2002 |
| EP | 1 229 182 | | 8/2002 |
| EP | 1 262 608 | A2 | 12/2002 |
| EP | 1 279 778 | A2 | 1/2003 |
| EP | 1 308 577 | A2 | 5/2003 |
| EP | 1 350 904 | A2 | 10/2003 |
| EP | 1 359 266 | A2 | 11/2003 |
| EP | 1 362 968 | | 11/2003 |
| EP | 1 367 194 | A2 | 12/2003 |
| EP | 1 420 125 | A2 | 5/2004 |
| EP | 1 437 457 | A2 | 7/2004 |
| EP | 2 400 076 | | 8/2004 |
| EP | 2009195 | B1 | 12/2008 |
| EP | 2 034 106 | | 3/2009 |
| FI | 843060 | A | 8/1984 |
| FR | 557844 | A | 8/1923 |
| FR | 1175582 | A | 3/1959 |
| FR | 1215852 | A | 4/1960 |
| FR | 1293043 | A | 5/1962 |
| FR | 1372596 | A | 9/1964 |
| FR | 1511292 | A | 1/1968 |
| FR | 2209024 | A1 | 6/1974 |
| FR | 2268922 | A1 | 11/1975 |
| FR | 2278876 | A1 | 2/1976 |
| FR | 2345560 | A1 | 10/1977 |
| FR | 2362254 | A1 | 3/1978 |
| FR | 2416988 | A1 | 9/1979 |
| FR | 2445874 | A1 | 8/1980 |
| FR | 2568295 | | 1/1986 |
| FR | 2630149 | | 10/1989 |
| FR | 2637932 | | 4/1990 |
| FR | 2675174 | | 10/1992 |
| FR | 2691491 | | 11/1993 |
| FR | 2691691 | | 12/1993 |
| FR | 2697275 | | 4/1994 |
| FR | 2712329 | | 5/1995 |
| FR | 2781513 | | 1/2000 |
| FR | 2785633 | | 5/2000 |
| FR | 2810060 | | 12/2001 |
| FR | 2891491 | A1 | 4/2007 |
| GB | 240629 | A | 10/1925 |
| GB | 356270 | A | 9/1931 |
| GB | 424057 | | 2/1935 |
| GB | 448329 | A | 6/1936 |
| GB | 471438 | A | 9/1937 |
| GB | 585205 | | 1/1947 |
| GB | 589635 | A | 6/1947 |
| GB | 599793 | | 3/1948 |
| GB | 636423 | | 4/1950 |
| GB | 647812 | A | 12/1950 |
| GB | 812671 | | 4/1959 |
| GB | 875327 | A | 8/1961 |
| GB | 1027709 | A | 4/1966 |
| GB | 1039949 | A | 8/1966 |
| GB | 1127915 | A | 9/1968 |
| GB | 1161838 | A | 8/1969 |
| GB | 1171337 | A | 11/1969 |
| GB | 1183401 | A | 3/1970 |
| GB | 1191656 | A | 5/1970 |
| GB | 1212983 | | 11/1970 |
| GB | 1237744 | | 6/1971 |
| GB | 1275511 | A | 5/1972 |
| GB | 1308011 | A | 2/1973 |
| GB | 1348272 | | 3/1974 |
| GB | 1430423 | | 3/1976 |
| GB | 1445687 | A | 8/1976 |
| GB | 1485419 | A | 9/1977 |
| GB | 2117813 | | 10/1983 |
| GB | 2124672 | A | 2/1984 |
| GB | 2126106 | | 3/1984 |
| GB | 2142670 | | 1/1985 |
| GB | 2168732 | | 6/1986 |
| GB | 2167465 | | 1/1989 |
| GB | 2221740 | A | 2/1990 |
| GB | 2228753 | | 9/1990 |
| GB | 2240039 | A | 7/1991 |
| GB | 2243381 | | 10/1991 |
| GB | 2256023 | | 11/1992 |
| GB | 2325342 | A | 11/1998 |
| GB | 2365880 | A | 2/2002 |
| IT | 444123 | | 1/1949 |
| IT | 812671 | | 4/1959 |
| JP | 5465528 | | 5/1979 |
| JP | 57119056 | | 7/1982 |
| JP | 59041560 | A | 3/1984 |
| JP | 59186336 | | 12/1984 |
| JP | S6414838 | A | 1/1989 |
| JP | S6414839 | U | 1/1989 |
| JP | 1178659 | | 7/1989 |
| JP | H 01178659 | A | 7/1989 |
| JP | H 02285145 | A | 11/1990 |
| JP | H 03318343 | U | 2/1991 |
| JP | 3046645 | | 4/1991 |
| JP | H 0344645 | | 4/1991 |
| JP | 3110258 | | 5/1991 |
| JP | H 03110258 | A | 5/1991 |
| JP | 3169967 | | 7/1991 |
| JP | 3202550 | | 9/1991 |
| JP | 4106264 | | 4/1992 |
| JP | 4191001 | | 7/1992 |
| JP | H 04191001 | A | 7/1992 |
| JP | 04261955 | A | 9/1992 |
| JP | H 0518028 | A | 1/1993 |
| JP | 5148984 | | 6/1993 |
| JP | 6146553 | | 5/1994 |
| JP | 6200611 | A | 7/1994 |
| JP | H 0656310 | U | 8/1994 |
| JP | 6315944 | A | 11/1994 |
| JP | 6320510 | | 11/1994 |
| JP | 407052103 | | 2/1995 |

(56) References Cited

FOREIGN PATENT DOCUMENTS

| | | | |
|---|---|---|---|
| JP | H 0 752103 | A | 2/1995 |
| JP | 7076923 | | 3/1995 |
| JP | 7180333 | | 7/1995 |
| JP | 7189466 | A | 7/1995 |
| JP | 7229276 | | 8/1995 |
| JP | H 07229276 | A | 8/1995 |
| JP | 7279366 | | 10/1995 |
| JP | H 07279366 | A | 10/1995 |
| JP | 7300979 | | 11/1995 |
| JP | 7310426 | | 11/1995 |
| JP | 961207 | | 2/1996 |
| JP | H 0874405 | A | 3/1996 |
| JP | 8086078 | | 4/1996 |
| JP | 8109734 | A | 4/1996 |
| JP | H 0886078 | A | 4/1996 |
| JP | 8270193 | A | 10/1996 |
| JP | H 08268344 | A | 10/1996 |
| JP | H 0938906 | A | 2/1997 |
| JP | H 0988315 | A | 3/1997 |
| JP | H 09256603 | A | 9/1997 |
| JP | H 10219975 | A | 8/1998 |
| JP | 3461569 | B2 | 10/2003 |
| JP | 5154806 | B2 | 8/2008 |
| JP | 4203141 | B2 | 12/2008 |
| JP | 5304714 | B2 | 10/2013 |
| KR | 9533446 | A | 12/1995 |
| NL | 7601773 | | 2/1975 |
| NO | 157871 | | 7/1984 |
| NO | 305614 | | 5/1995 |
| PL | 26931 | U1 | 6/1989 |
| SE | 372051 | | 12/1974 |
| SE | 7114900-9 | | 12/1974 |
| SE | 7706470 | | 12/1978 |
| SE | 450141 | | 6/1987 |
| SE | 8206934-5 | | 6/1987 |
| SE | 457737 | | 1/1989 |
| SE | 462809 | | 4/1990 |
| SE | 467150 | | 6/1992 |
| SE | 501014 | | 10/1994 |
| SE | 9301595-6 | | 10/1994 |
| SE | 9500810 | | 3/1995 |
| SE | 502994 | | 3/1996 |
| SE | 503861 | | 9/1996 |
| SE | 509059 | | 11/1998 |
| SE | 509060 | | 11/1998 |
| SE | 512290 | | 2/2000 |
| SE | 512313 | | 2/2000 |
| SE | 513189 | | 7/2000 |
| SE | 514645 | | 3/2001 |
| SE | 0001149 | | 10/2001 |
| SU | 363795 | A1 | 1/1973 |
| SU | 857393 | A1 | 8/1981 |
| WO | WO 80/02155 | | 10/1980 |
| WO | WO 82/00313 | A1 | 2/1982 |
| WO | WO 84/02155 | A1 | 6/1984 |
| WO | WO 87/03839 | | 7/1987 |
| WO | WO 90/00656 | A1 | 1/1990 |
| WO | WO 92/12074 | A2 | 7/1992 |
| WO | WO 92/17657 | | 10/1992 |
| WO | WO 93/13280 | | 7/1993 |
| WO | WO 93/19910 | A1 | 10/1993 |
| WO | WO 94/01628 | | 1/1994 |
| WO | WO 94/04773 | A1 | 3/1994 |
| WO | WO 94/22678 | A1 | 10/1994 |
| WO | WO 94/26999 | | 11/1994 |
| WO | WO 95/05274 | A1 | 2/1995 |
| WO | WO 95/06176 | A1 | 3/1995 |
| WO | WO 95/14834 | A1 | 6/1995 |
| WO | WO 96/12857 | | 5/1996 |
| WO | WO 96/23942 | | 8/1996 |
| WO | WO 96/27721 | | 9/1996 |
| WO | WO 97/27719 | | 9/1996 |
| WO | WO 96/30177 | | 10/1996 |
| WO | WO 97/47834 | | 12/1997 |
| WO | WO 98/22677 | A1 | 5/1998 |
| WO | WO 98/22678 | | 5/1998 |
| WO | WO 98/24994 | | 6/1998 |
| WO | WO 98/24995 | | 6/1998 |
| WO | WO 98/58142 | | 12/1998 |
| WO | WO 99/01628 | | 1/1999 |
| WO | WO 99/13179 | A1 | 3/1999 |
| WO | WO 99/40273 | | 8/1999 |
| WO | WO 99/66151 | | 12/1999 |
| WO | WO 99/66152 | | 12/1999 |
| WO | WO 00/06854 | | 2/2000 |
| WO | WO 00/20705 | A1 | 4/2000 |
| WO | WO 00/20706 | A1 | 4/2000 |
| WO | WO 00/47814 | A1 | 8/2000 |
| WO | WO 00/47841 | A1 | 8/2000 |
| WO | WO 00/56802 | | 9/2000 |
| WO | WO 00/63510 | | 10/2000 |
| WO | WO 00/66856 | | 11/2000 |
| WO | WO 00-02214 | | 1/2001 |
| WO | WO 01/02669 | | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/20101 | | 3/2001 |
| WO | WO 01/31141 | | 5/2001 |
| WO | WO 01/48332 | A1 | 7/2001 |
| WO | WO 01/51732 | A1 | 7/2001 |
| WO | WO 01/51733 | | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 01/88307 | A1 | 11/2001 |
| WO | WO 01/94721 | | 12/2001 |
| WO | WO 01/96688 | A1 | 12/2001 |
| WO | WO 01/98604 | A1 | 12/2001 |
| WO | WO 02/055809 | A1 | 7/2002 |
| WO | WO 02/055810 | A1 | 7/2002 |
| WO | WO 02/081843 | | 10/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 03/093686 | | 11/2003 |
| WO | WO 2004/016877 | A1 | 2/2004 |
| WO | WO 2004/020764 | A1 | 3/2004 |
| WO | WO 2004/081316 | A1 | 9/2004 |
| WO | WO 2004/085765 | A1 | 10/2004 |
| WO | WO 2005/040521 | | 5/2005 |
| WO | WO 2005/054599 | A1 | 6/2005 |
| WO | WO 2005/059269 | | 6/2005 |
| WO | WO 2008/004960 | | 1/2006 |
| WO | WO 2006/043893 | A1 | 4/2006 |
| WO | WO 2006/104436 | A1 | 10/2006 |
| WO | WO 2007/008139 | | 1/2007 |
| WO | WO 2007/089186 | | 8/2007 |
| WO | WO 2007/141605 | A2 | 12/2007 |
| WO | WO 2008/068245 | | 6/2008 |
| WO | WO 2009/066153 | | 5/2009 |
| WO | WO 2009/116926 | | 9/2009 |
| WO | WO 2009/139687 | | 11/2009 |
| WO | WO 2010/082171 | | 7/2010 |
| WO | WO 2010/018980 | | 9/2010 |
| WO | WO 2010/136171 | A1 | 12/2010 |
| WO | WO 2011/085788 | | 7/2011 |
| WO | WO 2011/085825 | | 7/2011 |
| WO | WO 2011/087425 | | 7/2011 |
| WO | WO 2011/096879 | | 8/2011 |
| WO | WO 2011/141043 | | 11/2011 |

(56) References Cited

OTHER PUBLICATIONS

Traditional Details; For Building Restoration Renovation, and Rehabilitation: From the 1932-1951 Editions of Architecvral Graphic Standards; John Wiley & Sons, Inc.
Traindustrins Handbook "Snickeriarbete", Knut Larsson, Tekno's Handbocker Publikation 12-11 (1952).
Elements of Rolling Practice; The United Steel Companies Limited Sheffield, England, 1963; pp. 116-117.
Die mobile; Terbrak; 1968.
High-Production Roll Forming; Society of Manufacturing Engineers Marketing Services Depmiment; pp. 189-192; George T. Halmos; 1983.
Fundamentals of Building Construction Materials and Methods; Copyright 1985; pp. 11. Automated Program of Designing Snap-fits; Aug. 1987; pp. 3.
Automated Program of Designing Snap-fits; Aug. 1987; pp. 3.
Plastic Part Technology; 1991; pp. 161-162.
Technoscope; Modern Plastics, Aug. 1991; pp. 29-30.
Encyclopedia of Wood Joints; A Fine Woodworking Book; pp. 1-151; 1992.
Whittington's Dictionary of Plastics; Edited by James F. Carley, Ph.D., PE; pp. 443, 461; 1993.
Patent Mit Inter-nationalem, Die Revolution ((von Grund auf)) Fibo-Trespo, Disstributed at the Domotex fair in Hannover, Germany in Jan. 1996.
International Search Report for PCT/SE 96/00256 dated Jun. 26, 1996.
Wood Handbook; Forest Products Laboratory, 1999; "Glossary pp. G-1 to 0-14", "Chapter 10, pp. 10-1 to 10-31".
U.S. Appl. No. 90/637,036, filed Oct. 2000, Pervan.
Focus, Information Till Ana Medabetare, Jan. 2001, Kahrs pa Domotex I Hmmover, Tysklm1d, Jan. 13-16, 2001.
Search Report dated Apr. 21, 2001.
Letter to the USPTO dated May 14, 2002, regarding U.S. Appl. No. 90/005,744.
Non-Final Office Action for U.S. Appl. No. 10/270,163 dated Dec. 10, 2004.
Final Office Action for U.S. Appl. No. 10/270,163 dated Jun. 2, 2005.
Non-Final Office Action for U.S. Appl. No. 10/015,741 dated Jun. 29, 2005.
Notice of Allowance for U.S. Appl. No. 10/015,741 dated Dec. 1, 2005.
Non-Final Office Action for U.S. Appl. No. 10/270,163 dated Dec. 14, 2005.
Final Office Action for U.S. Appl. No. 10/270,163 dated May 25, 2006.
Non-Final Office Action for U.S. Appl. No. 11/185,724 dated Sep. 26, 2006.
Non-Final Office Action for U.S. Appl. No. 11/483,636 dated Oct. 11, 2006.
Reexamination No. 90/007,366 dated Oct. 24, 2008.
Reexamination No. 90/007, 526 dated Dec. 5, 2006.
International Search Report for Application No. PCT/SE2007/000070 dated Mar. 29, 2007.
Non-Final Office Action for U.S. Appl. No. 11/185,724 dated Apr. 19, 2007.
Non-Final Office Action for U.S. Appl. No. 11/483,636 dated Apr. 19, 2007.
Non-Final Office Action for U.S. Appl. No. 11/015,741 dated Sep. 6, 2007.
Non-Final Office Action for U.S. Appl. No. 11/242,127 dated Nov. 1, 2007.
Non-Final Office Action for U.S. Appl. No. 11/135,724 dated Jan. 9, 2008.
Final Office Action for Application No. 11/015,741 dated Feb. 26, 2008.
Non-Final Office Action for U.S. Appl. No. 11/483,636 dated Apr. 3, 2008.
Non-Final Office Action for U.S. Appl. No. 11/242,127 dated Apr. 29, 2008.
United States District Court Eastern District of Wisconsin; Order; Dated May 1, 2008.
Examiner Interview Summary for U.S. Appl. No. 11/015,741 dated May 7, 2008.
Final Office Action for U.S. Appl. No. 11/185,724 dated Jul. 9, 2008.
Non-Final Office Action for U.S. Appl. No. 10/530,191 dated Jul. 16, 2003.
Reexamination No. 90/007,365 dated Aug. 5, 2008.
United Stateds District Court Eastern District of Wisonsin; Judgment; Dated Oct. 10, 2008.
United States District Court Eastern District of Wisconsin; Order; Dated Oct. 10, 2008.
Fianl Office Action for U.S. Appl. No. 11/483,636 dated Nov. 20, 2008.
United States District Court Eastern District of Wisconsin; Order; Dated Dec. 31, 2008.
Non-Final Office Action for U.S. Appl. No. 11/242,127 dated Mar. 31, 2009.
Non-Final Office Action for U.S. Appl. No. 12/010,587 dated Jun. 23, 2009.
Non-Final Office Action for U.S. Appl. No. 11/483,636 dated Jul. 21, 2009.
Non-Final Office Action for U.S. Appl. No. 12/010,587 dated Oct. 10, 2012.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
United States Court of Appeals for Federal Circuit; 2009-1107,-1122; Decided: Feb. 18, 2010.
Appeals from the United States District Court for the Eastern District of Wisconsin; Consolidated case No. 02-CV-0736 and 03-CV-616; Judge J.P. Stadtmueller, 2009-1107,-1122. Revised Feb. 25, 2010.
Non-Final Office Action for U.S. Appl. No. 10/580,191 dated Mar. 10, 2010.
Non-Final Office Action for U.S. Appl. No. 11/483,636 dated Mar. 17, 2010.
United States Court of Appeals of the Federal Circuit; Case No. 02-CV-0736 and 03-CV-616; Mandate issued on Apr. 12, 2010; Judgment; 2 pages.
Final Office Action for U.S. Appl. No. 12/278,274 dated May 17, 2010.
Final Office Action for U.S. Appl. No. 12/010,587 dated May 25, 2010.
Advisory Action for U.S. Appl. No. 12/278,274 dated Sep. 27, 2010.
Final Office Action for U.S. Appl. No. 10/530,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Advisory Action for U.S. Appl. No. 10/580,191 dated Feb. 15, 2011.
Non-Final Office Action for U.S. Appl. No. 12/010,587 dated Mar. 16, 2011.
Inernational Search Report for Application No. PCT/EP2010/006772 dated Mar. 31, 2011.
Final Office Action for U.S. Appl. No. 12/278,274 dated Apr. 14, 2011.
Fianl Office Action for U.S. Appl. No. 11/483,636 dated May 24, 2011.
Non-Final Office Action for U.S. Appl. No. 13/048,646 dated May 25, 2011.
Non-Final Office Action for U.S. Appl. No. 12/966,861 dated Jul. 20, 2011.
Non-Final Office Action for U.S. Appl. No. 12/979,066 dated Aug. 3, 2011.

(56) References Cited

OTHER PUBLICATIONS

Non-Final Office Action for U.S. Appl. No. 12/010,587 dated Aug. 30, 2011.
Non-Final Office Action for U.S. Appl. No. 11/483,636 dated Sep. 28, 2011.
Decision revoking the European Patent EP-B-1 276 941 dated Oct. 21, 2011.
European Patent Office Oppostion Division Decision for Application No. 01906461.7 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Final Office Action for U.S. Appl. No. 11/483,636 dated Feb. 7, 2011.
Non-Final Office Action for U.S. Appl. No. 12/966,797 dated Feb. 29, 2012.
Final Office Action for U.S. Appl. No. 13/204,481 dated Mar. 12, 2012.
Final Office Action for U.S. Appl. No. 12/010,587 dated Mar. 22, 2012.
Notice of Allowance for U.S. Appl. No. 12/966,861 dated Apr. 11, 2012.
Non-Final Office Action for U.S. Appl. No. 13/437,597 dated Jul. 9, 2012.
Restriction Requirement for U.S. Appl. No. 13/452,183 dated Jul. 10, 2012.
Notice of Allowance for U.S. Appl. No. 12/979,086 dated Jul. 19, 2012.
Non-Final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.
Final Office Action for U.S. Appl. No. 13/204,481 dated Sep. 7, 2012.
Non-Final Office Action for U.S. Appl. No. 13/567,933 dated Sep. 12, 2012.
Non-Final Office Action for U.S. Appl. No. 11/483,636 dated Oct. 10, 2012.
Advisory Action for U.S. Appl. No. 13/966,797 dated Oct. 18, 2012
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Non-Final Office Action for U.S. Appl. No. 13/492,512 dated Nov. 21, 2012.
Non-Final Office Action for U.S. Appl. No. 13/463,329 dated Nov. 21, 2012.
Notice of Allowance for U.S. Appl. No. 11/483,636 dated Nov. 23, 2012.
Notice of Allowance for U.S. Appl. No. 10/270,163 dated Dec. 13, 2012.
Non-Final Office Action for U.S. Appl. No. 12/966,797 dated Dec. 13, 2012.
Non-Final Office Action for U.S. Appl. No. 13/559,230 dated Dec. 20, 2012.
Non-Final Office Action for U.S. Appl. No. 13/675,936 dated Dec. 31, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Final Office Action for U.S. Appl. No. 12/010,587 dated Jan. 28, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Office Action for U.S. Appl. No. 11/015,741 dated Mar. 13, 2013.
Final Office Action for U.S. Appl. No. 13/567,933 dated Mar. 15, 2013.
Notice of Allowance of U.S. Appl. No. 11/242,127 dated Apr. 26, 2013.
Notice of Allowance for U.S. Appl. No. 13/437,597 dated Apr. 29, 2013.
Non-Final Office Action for U.S. Appl. No. 12/747,454 dated May 10, 2013.
Notice of Allowance for U.S. Appl. No. 11/185,724 dated May 20, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Corrected Notice of Allowability for U.S. Appl. No. 11/185,724 dated Aug. 1, 2013.
Final Office Action for U.S. Appl. No. 13/086,931 dated Aug. 5, 2013.
Notice of Allowance for U.S. Appl. No. 12/966,797 dated Aug. 7, 2013.
Notice of Allowance for U.S. Appl. No. 12/010,587 dated Aur. 14, 2013.
Notice of Allowance for U.S. Appl. No. 13/559,230 dated Aug. 20, 2013.
Non-Final Office Action for U.S. Appl. No. 13/860,315 dated Aug. 26, 2013.
Notice of Allowance for U.S. Appl. No. 11/185,724 dated Sep. 3, 2013.
Non-Final Office Action for U.S. Appl. No. 13/204,481 dated Sep. 4, 2013.
Final Office Action for U.S. Appl. No. 13/620,098 dated Sep. 24, 2013.
Non-Final Office Action for U.S. Appl. No. 13/463,329 dated Sep. 25, 2013.
Notice of Allowance for U.S. Appl. No. 13/675,936 dated Sep. 25, 2013.
Supplemental Notice of Allowance for U.S. Appl. No. 12/966,797 dated Oct. 3, 2013.
Supplemental Notice of Allowance for U.S. Appl. No. 13/559,230 dated Oct. 4, 2013.
Notice of Allowance for U.S. Appl. No. 11/185,724 dated Nov. 1, 2013.
Final Office Action for U.S. Appl. No. 12/747,454 dated Nov. 6, 2013.
Notice of Allowance for U.S. Appl. No. 13/086,931 dated Nov. 19, 2013.
Fiboloc Literature, Mar. 1999.
Final Office Action for U.S. Appl. No. 12/747,454 dated Feb. 24, 2014.
Supplemental Notice of Allowance for U.S. Appl. No. 13/086,931 dated Apr. 14, 2014.
Abandoned U.S. Appl. No. 13/420,282 dated Mar. 14, 2012.
Re-Issued Pending U.S. Appl. No. 14/044,572, and Reissue Declaration Filed in Accordance With MPEP 1414, both filed Oct. 2, 2013.
Non-Final Office Action for U.S. Appl. No. 13/957,971 dated Feb. 20, 2014.
Non-final Office Action for U.S. Appl. No. 13/620,095 dated Mar. 21, 2014.
Final Office Action for U.S. Appl. No. 13/463,329 dated May 16, 2014.
Non-Final Office Action for U.S. Appl. No. 14/097,001 dated Jun. 12, 2014.

(56) References Cited

OTHER PUBLICATIONS

Notice of Allowance for U.S. Appl. No. 13/567,933 dated Jun. 17, 2014.
Non-Final Office Action for U.S. Appl. No. 14/223,365 dated Jul. 3, 2014.
Notice of Allowance for U.S. Appl. No. 13/620,098 dated Jul. 22, 2014.
European Patent Office Board of Appeal Decision for Application No. 01906461.7 dated Jul. 24, 2014.
Non-Final Office Action for U.S. Appl. No. 14/036,724 dated Aug. 1, 2014.
Final Office Action for U.S. Appl. No. 13/957,971 dated Sep. 3, 2014.
Non-final Office Action for U.S. Appl. No. 12/747,454 dated Sep. 12, 2014.
Notice of Allowance for U.S. Appl. No. 13/620,098 dated Sep. 18, 2014.
Non-Final Office Action for U.S. Appl. No. 14/086,757 dated Oct. 7, 2014.
Non-Final Office Action for U.S. Appl. No. 14/076,879 dated Oct. 14, 2014.
Notice of Allowance for U.S. Appl. No. 13/567,933 dated Oct. 16, 2014.
Notice of Allowance for U.S. Appl. No. 14/223,365 dated Nov. 5, 2014.
Advisory Action for U.S. Appl. No. 13/957,971 dated Dec. 17, 2014.
Notice of Allowance for U.S. Appl. No. 13/463,329 dated Dec. 31, 2014.
Final Office Action for U.S. Appl. No. 14/086,724 dated Jan. 16, 2015.
Notice of Allowance for U.S. Appl. No. 13/860,315 dated Jan. 20, 2015.
Non-Final Office Action for U.S. Appl. No. 13/957,971 dated Jan. 30, 2015.
Notice of Allowance for U.S. Appl. No. 13/567,933 dated Feb. 4, 2015.
Final Office Action for U.S. Appl. No. 14/076,879 dated Mar. 4, 2015.
Notice of Allowance for U.S. Appl. No. 13/860,315 dated Mar. 5, 2015.
Final Office Action for U.S. Appl. No. 14/086,757 dated Mar. 17, 2015.
Non-Final Office Action for U.S. Appl. No. 13/204,481 dated Mar. 25, 2015.
Non-Final Office Action for U.S. Appl. No. 14/456,755 dated Mar. 27, 2015.
Notice of Allowance for U.S. Appl. No. 13/860,315 dated Apr. 6, 2015.
Non-Final Office Action for U.S. Appl. No. 14/044,572 dated Apr. 6, 2015.
Notice of Allowance for U.S. Appl. No. 14/086,724 dated Apr. 15, 2015.
Non-Final Office Action for U.S. Appl. No. 14/658,954 dated Apr. 24, 2015.
Final Office Action for U.S. Appl. No. 14/076,879 dated Apr. 24, 2015.
Notice of Allowance for U.S. Appl. No. 13/048,646 dated May 14, 2015.
Notice of Allowance for U.S. Appl. No. 13/567,933 dated May 22, 2015.
Notice of Allowance for U.S. Appl. No. 14/086,724 dated Jun. 1, 2015.
Advisory Action for U.S. Appl. No. 14/086,757 dated Jul. 10, 2015.
Non-Final Office Action for U.S. Appl. No. 14/086,757 dated Aug. 3, 2015.
Final Office Action for U.S. Appl. No. 13/957,971 dated Aug. 6, 2015.
Notice of Allowance for U.S. Appl. No. 14/098,187 dated Sep. 19, 2015.
Notice of Allowance for U.S. Appl. No. 13/567,933 dated Sep. 15, 2015.
Notice of Allowance for U.S. Appl. No. 14/097,001 dated Sep. 16, 2015.
Final Office Action for U.S. Appl. No. 14/076,879 dated Oct. 22, 2015.
Final Office Action for U.S. Appl. No. 14/456,755 dated Oct. 27, 2015.
Final Office Action for U.S. Appl. No. 14/658,954 dated Nov. 9, 2015.
Non-Final Office Action for U.S. Appl. No. 13/492,512 dated Nov. 17, 2015.
Advisoly Action for U.S. Appl. No. 13/957,971 dated Dec. 1, 2015.
Notice of Allowance for U.S. Appl. No. 13/360,315 dated Dec. 9, 2015.
Non-Final Office Action for U.S. Appl. No. 13/957,971 dated Dec. 18, 2015.
Restriction Requirement for U.S. Appl. No. 14/844,877 dated Dec. 31, 2015.
Non-Final Office Action for U.S. Appl. No. 14/821,293 dated Feb. 2, 2016.
Notice of Allowance for U.S. Appl. No. 13/204,481 dated Feb. 3, 2016.
Final Office Action for U.S. Appl. No. 14/036,757 dated Feb. 11, 2016.
U.S. Appl. No. 09/891,460 for "High friction joint, and interlocking joints for forming a generally plannar surface, and method of assembling the same", (filed Jun. 27, 2001).
Non-Final Office Action for U.S. Appl. No. 10/835,542 dated May 4, 2007.
Final Office Action for U.S. Appl. No. 10/835,542 dated Oct. 18, 2007.
Non-Final Office Action for U.S. Appl. No. 10/835,542 dated Apr. 2, 2008.
Final Office Action for U.S. Appl. No. 10/835,542 dated Sep. 30, 2008.
Non-Final Office Action for U.S. Appl. No. 10/835,541 dated Mar. 9, 2009.
Final Office Action for U.S. Appl. No. 10/835,542 dated Sep. 1, 2009.
Non-Final Office Action for U.S. Appl. No. 14/658,954 dated Jul. 1, 2016.
Non-Final Office Action for U.S. Appl. No. 14/844,877 dated Aug. 2, 2016.
Notice of Allowance for U.S. Appl. No. 14/076,879 dated Aug. 19, 2016.
Non-Final Office Action for U.S. Appl. No. 14/292,474 dated Sep. 22, 2016.
Notice of Allowance for U.S. Appl. No. 14/076,879 dated Sep. 26, 2016.
Notice of Allowance for U.S. Appl. No. 14/658,954 dated Oct. 26, 2016.
Notice of Allowance for U.S. Appl. No. 13/567,933 dated Dec. 12, 2016.
Notice of Allowance for U.S. Appl. No. 15/131,977 dated Dec. 23, 2016.
Patent Abstract of Japan, Publication No. 07300979, Konishi et al, Nov. 1995.
Advisory Action for U.S. Appl. No. 10/270,163 dated Sep. 15, 2005.
Advisory Action for U.S. Appl. No. 10/270,163 dated Aug. 8, 2006.
Restriction Requirement for U.S. Appl. No. 10/580,191 dated May 12, 2008.
Restriction Requirement for U.S. Appl. No. 11/242,127 dated Dec. 8, 2008.
Restriction Requirement for U.S. Appl. No. 12,010,587 dated Apr. 27, 2009.
Restriction Requirement for U.S. Appl. No. 12/010,587 dated Jan. 20, 2010.
Advisory Action for U.S. Appl. No. 11/242,127 dated Mar. 18, 2010.
Advisory Action for U.S. Appl. No. 12/010,587 dated Sep. 13, 2010.
Non-Final Office Action for U.S. Appl. No. 12/240,739 dated Oct. 5, 2011.

(56) References Cited

OTHER PUBLICATIONS

Restriction Requirement for U.S. Appl. No. 12/966,797 dated Jan. 31, 2012.
Notice of Allowance for U.S. Appl. No. 12/240,739 dated Feb. 2, 2012.
Advisory Action for U.S. Appl. No. 13/204,481dated May 24, 2012.
Advisory Action for U.S. Appl. No. 12/010,587 dated May 30, 2012.
Restriction Requirement for U.S. Appl. No. 13/957,971 dated Nov. 12, 2013.
Notice of Allowance for U.S. Appl. No. 12/966,797 dated Dec. 5, 2013.
Notice of Allowance for U.S. Appl. No. 13/086,931 dated Jan. 31, 2014.
Notice of Allowance for U.S. Appl. No. 13/086,931 dated Mar. 18, 2014.
Final Office Action for U.S. Appl. No. 13/204,481 dated Apr. 22, 2014.
Restriction Requirement for U.S. Appl. No. 14/076,879 dated May 23, 2014.
Non-Final Office Action for U.S. Appl. No. 14/098,187 dated Jun. 16, 2014.
Final Office Action for U.S. Appl. No. 13/204,481 dated Oct. 30, 2014.
Notice of Allowance for U.S. Appl. No. 14/097,001 dated Dec. 24, 2014.
Notice of Allowance for U.S. Appl. No. 14/098,187 dated Dec. 26, 2014.
Notice of Allowance for U.S. Appl. No. 14/098,187 dated Apr. 8, 2015.
Notice of Allowance for U.S. Appl. No. 14/097,001 dated Apr. 15, 2015.
Notice of Allowance for U.S. Appl. No. 13/860,315 dated Aug. 21, 2015.
Final Office Action for U.S. Appl. No. 13/204,481 dated Sep. 21, 2015.
Advisory Action for U.S. Appl. No. 14/658,954 dated Mar. 3, 2016.
Final Office Action for U.S. Appl. No. 14/044,572 dated Mar. 18, 2016.
Notice of Allowance for U.S. Appl. No. 14/456,755 dated Apr. 6, 2016.
United States Patent U.S. Appl. No. 15/131,977 filed Apr. 18, 2016.
Notice of Allowance for U.S. Appl. No. 13/957,971 dated May 9, 2016.
Non-Final Office Action for U.S. Appl. No. 15/131,977 dated Jun. 8, 2016.
E1—"Versatility with the UltraLock System!" Feb. 9, 2000—Alleged Prior Art European Patent Office Opposition for Application No. 01906461.7.
E2—Photographs of "Long Side" and "Short Side," Nov. 1999—Alleged Prior Art European Patent Office Opposition for Application No. 019046461.7.
European Patent Office Opposition for Application No. 08166656 dated Jan. 20, 2016.
Response to European Patent Office Opposition for Application No. 08166656 dated Aug. 22, 2016.
U.S. Appl. No. 09/891,460 for "High friction joint, and interlocking joints for forming a generally planar surface, and method of assembling the same," (filed Jun. 27, 2001).
Non-Final Office Action for U.S. Appl. No. 10/835,542 dated Mar. 9, 2009.

BUILDING PANELS

CROSS-REFERENCE TO RELATED APPLICATIONS

This application is a continuation of and claims priority to U.S. application Ser. No. 14/098,187, filed Dec. 5, 2013, which is a continuation of U.S. application Ser. No. 13/860,315, filed Apr. 10, 2013, which is a continuation of U.S. application Ser. No. 13/437,597, filed Apr. 2, 2012, now U.S. Pat. No. 8,544,233, which is a continuation of and claims priority to U.S. application Ser. No. 12/240,739, filed Sep. 29, 2008, now U.S. Pat. No. 8,146,318, which is a divisional of U.S. application Ser. No. 11/540,583, filed Oct. 2, 2006, now U.S. Pat. No. 7,441,385, which is a continuation of U.S. application Ser. No. 10/286,982, filed Nov. 4, 2002, now U.S. Pat. No. 7,121,058, which is a continuation in part of each of U.S. Application No. 09/988,014, filed Nov. 16, 2001, U.S. application Ser. No. 09/672,076, filed Sep. 29, 2000, now U.S. Pat. No. 6,591,568, and U.S. application Ser. No. 10/242,674, filed Sep. 13, 2002, now U.S. Pat. No. 7,332,053. U.S. application Ser. No. 10/286,982 also claims priority to Swedish Application No. 0001149-4, filed Mar. 31, 2000. The entire disclosures of each of the above applications are incorporated herein by reference in their entireties.

BACKGROUND

1. Field of the Invention

The present invention relates to a flooring material comprising sheet-shaped floor elements which are joined by means of joining members.

2. Background

Prefabricated floor boards provided with tongue and groove at the edges are quite common nowadays. These can be installed by the average handy man as they are very easy to install. Such floors can, for example. be constituted of solid wood, or of wood particles consolidated by use of a binder including fibre board, such as high or medium density fibre board (HDF or MDF), particle board, chip board, oriented strand board (OSB) or any other construction comprising particles of wood bonded together with a binder. These are most often provided with a surface layer such as lacquer, or some kind of laminate. The boards are most often installed by being glued via tongue and groove. The most common types of longue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilize in floors where no glue is to be used.

Such a joint is known through WO 94/26999 (herein incorporated by reference in its entirety) which deals with a system to join two floor boards. The floor boards are provided with a locking device at the rear sides. In one embodiment the floor boards are provided with profiles on the lower side at a first long side and short side: These profiles, which extends outside the floor board itself, is provided with an upwards directed lip which fits into grooves on the lower side of a corresponding floor board. These grooves are arranged on the second short side and long side of this floor board. The floor boards are furthermore provided with a traditional tongue and groove on the edges. The intentions are that the profiles shall bend downwards and then to snap back into the groove when assembled. The profiles are integrated with the floor boards through folding or alternatively, through gluing.

According to WO 94/26999, the floor boards may be joined by turning or prizing it into position with the long side edge as a pivot point. It is then necessary to slide the floor board longitudinally so that it snaps into the floor board previously installed in the same row. A play is essential in order to achieve that. This play seems to be marked Δ in the figures. A tolerance of ±2 mm is mentioned in the application. Such a play will naturally cause undesired gaps between the floor boards. Dirt and moisture can penetrate into these gaps.

It is also known through WO 97/47834 (herein incorporated by reference in its entirety) to manufacture a joint where the floor boards are joined by turning or prizing it into position with the long side edge as a pivot point. According to this invention a traditional tongue has been provided with heel on the lower side. The heel has a counterpart in a recess in the groove of the opposite side of the floor board. The lower cheek of the groove will be bent away during the assembly and will then snap back when the floor board is in the correct position. The snap-joining parts, i.e. the tongue and groove, is in opposite to the invention according to WO 94/26999 above, where they are constituted by separate parts, seems to be manufactured monolithically from the core of the floor board. WO 97/47834 does also show how the tongue and groove with heels and recesses according to the invention is tooled by means of cutting machining. This invention does also have the disadvantage that the best mode of joining floor boards includes longitudinal sliding for joining the short sides of the floor boards, which also here will require a play which will cause unwanted gaps between the floor boards. Dirt and moisture can penetrate into these gaps.

SUMMARY OF THE INVENTION

It is, through the present invention, made possible to solve the above mentioned problems whereby a floor element which can be assembled without having to be slid along already assembled floor elements has been achieved. Accordingly, the invention relates to a flooring material comprising sheet-shaped floor elements with a mainly square or rectangular shape. The floor elements are provided with edges, a lower side and an upper decorative layer. The floor elements are intended to be joined by means of joining members. The invention is characterized in that;

a) The floor elements are provided with male joining members on a first edge while a second, opposite, edge of the floor elements are provided with a female joining member. The male joining member is provided with a tongue and a lower side groove. The female joining member is provided with a groove and a cheek, the cheek being provided with a lip. The floor elements are intended to mainly be joined together by tilting the floor element to be joined with an already installed floor element or a row of already installed floor elements, with the male joining member of the floor element angled downwards and that the first edge is allowed to be mainly parallel to the second edge of the already installed floor element or elements. The tongue of the tilted floor element is then inserted into the groove of the female joining member of the already installed floor element or elements. The tilted floor element is then turned downwards, with its lower edge as a pivot axis, so that the lip eventually snaps into the lower side groove where the decorative upper layer of the floor elements are mainly parallel.

b) The floor elements are moreover provided with a male vertical assembly joining member on a third edge while a fourth edge is provided with female vertical assembly joining member. The fourth edge is arranged on a side opposite to the third edge.

c) The floor elements are alternatively provided with a male vertical assembly joining member on a third edge, while a fourth edge also is provided with male vertical assembly joining member. The fourth edge is arranged on a side opposite to the third edge. Adjacent male vertical assembly joining members are thereby joined by means of a separate vertical assembly joining profile. Two adjacent edges of a floor element can hereby be joined with a floor element adjacent to the first edge and a floor element adjacent to the third or fourth edge at the same time, and in the same turning motion.

The force needed to overcome the static friction along the joint between two completely assembled male and female joining members is preferably larger than 10N per meter of joint length, suitably larger than 100N per meter of joint length.

According to one embodiment of the invention, the floor elements are provided with male vertical assembly joining members on a third edge and provided with female vertical assembly joining members on a fourth edge. The male vertical assembly joining members are provided with mainly vertical lower cheek surfaces arranged parallel to the closest edge. The lower cheek surfaces are intended to interact with mainly vertical upper cheek surfaces arranged on the female vertical assembly joining members so that two joined adjacent floor elements are locked against each other in a horizontal direction. The male and female vertical assembly joining members are provided with one or more snapping hooks with matching under cuts which by being provided with mainly horizontal locking surfaces limits the vertical movement between two joined adjacent floor elements.

The floor elements may alternatively be provided with male vertical assembly joining members on both a third and a fourth edge. These edges are then snap joined by means of a vertical assembly profile which on both sides of a longitudinal symmetry line is designed as a female vertical assembly joining member according to the description above. Two joined adjacent floor elements are locked to each other in a horizontal direction via the vertical assembly profile while, at the same time, vertical movement between two joined adjacent floor elements is limited.

The joint between a third and a fourth edge of two joined floor elements preferably comprises contact surfaces which are constituted by the horizontal locking surfaces of the under cuts and hooks, the mainly vertical upper cheek surfaces and lower cheek surfaces as well as upper mating surfaces.

The joint between two joined floor elements suitably also comprises cavities.

According to one embodiment of the invention the snapping hook is constituted by a separate spring part which is placed in a cavity. Alternatively the undercut is constituted by a separate spring part which is placed in a cavity. The spring part is suitably constituted by an extruded thermoplastic profile, a profile of thermosetting resin or an extruded metal profile.

The vertical assembly joining profiles are suitably shaped as extended profiles which suitably are manufactured through extrusion which is a well known and rational method. The vertical assembly joining profiles are suitably shaped as extended lengths or rolls which can be cut to the desired length. The length of the vertical assembly joining profiles considerably exceeds the length of a floor element, before being cut. The lateral joints of the floor will only need shorter pieces of vertical assembly joining profiles which are positioned as each new floor board is introduced to a row. Vertical assembly joining profiles according to the present invention may be manufactured of a number of different materials and manufacturing methods. Among the most suited can, however, be mentioned injection moulding and extrusion. Suitable materials are thermoplastic materials such as polyolefins, polystyrene, polyvinyl chloride or acrylnitrile-butadiene-styrene copolymer. These may suitably be filled with, for example, wood powder or lime in order to increase the rigidity but also to increase the adhesion when glue is used. It is also possible to mill a vertical assembly joining profile from a material such as wood, fibre board or particle board.

The flooring material including the floor boards and joining profiles above is most suited when installing floors where it isn't desired to use glue. It is, however, possible to use glue or twin-faced adhesive tape in order to make the installation irreversibly permanent. The glue or tape is then suitably applied on, or in connection to, possible cavities or faces below the upper mating surfaces.

BRIEF DESCRIPTION OF THE DRAWINGS

The invention is described further in connection to enclosed figures showing different embodiments of a flooring material whereby.

DETAILED DESCRIPTION OF THE INVENTION

Figure 1:
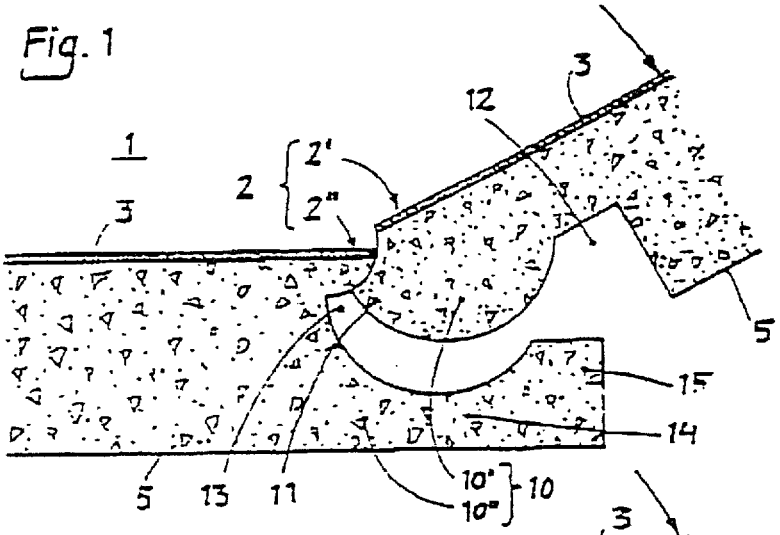
FIG. 1 shows, in cross-section, a first and a second edge $\mathbf{2}^{I}$ and $\mathbf{2}^{II}$ respectively, during joining

FIG. 1 shows, in cross-section, a first and a second edge $2^{I}$ and $2^{II}$ respectively, during assembly. The figure shows pans of a flooring material comprising sheet-shaped floor elements 1 with a mainly square or rectangular shape. The floor elements 1 are provided with edges 2, a lower side 5 and an upper decorative layer 3. The floor elements 1 are intended to be joined by means of joining members 10. Such floors floor elements, for example, be constituted of solid wood, fibre board, such as medium density fibre board (MDF), particle board, chip board, or any other construction comprising pieces or particles of wood, including combinations of plastic elements and the particles or pieces of wood. The floor elements 1 are provided with male joining members 101 on a first edge $2^{I}$ while a second edge $2^{II}$ of the floor elements 1 are provided with a female joining member $10^{II}$. The second edge $2^{II}$ is arranged on a side opposite to the first edge $2^{I}$. The male joining member $10^{1}$ is provided with a tongue 11 and a lower side 5 groove 12. The female joining member $10^{II}$ is provided with a groove 13 and a cheek 14, the cheek 14 being provided with a lip 15. The floor elements 1 are intended to mainly be joined together by tilting the floor element 1 to be joined with an already installed floor element 1 or a row of already installed floor elements 1, with the male joining member $10^{I}$ of the floor element 1 angled downwards and that the first edge 21 is allowed to be mainly parallel to the second edge $2^{II}$ of the already installed floor element 1 or elements 1. The tongue 11 of the tilted floor element 1 is then inserted into the groove 13 of the female joining member $10^{II}$ of the already installed floor element 1 or elements 1, whereby the tilted floor element 1 is turned downwards, with its lower edge as a pivot axis, so that the lip 15 eventually falls into the lower side 5 groove 12 where the decorative upper layer 3 of the floor elements 1 are mainly parallel.

The embodiment shown in FIG. 1 corresponds mainly with the one shown in FIG. 1. The lip 15 and lower side 5 groove 12 are, however, provided with a cam 16 and a cam groove 17 which provides a snap action locking.

Figure 2:
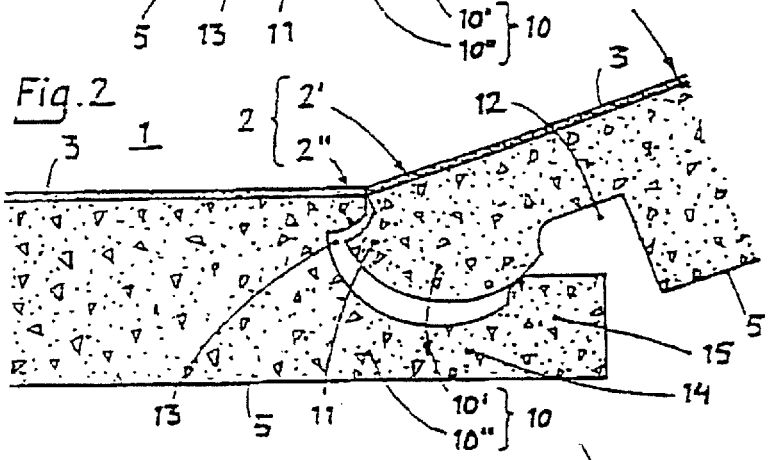
FIG. 2 shows, in cross-section, a second embodiment of a first and a second edge $\mathbf{2}^{I}$ and $\mathbf{2}^{II}$ respectively, during joining.
Figure 3:
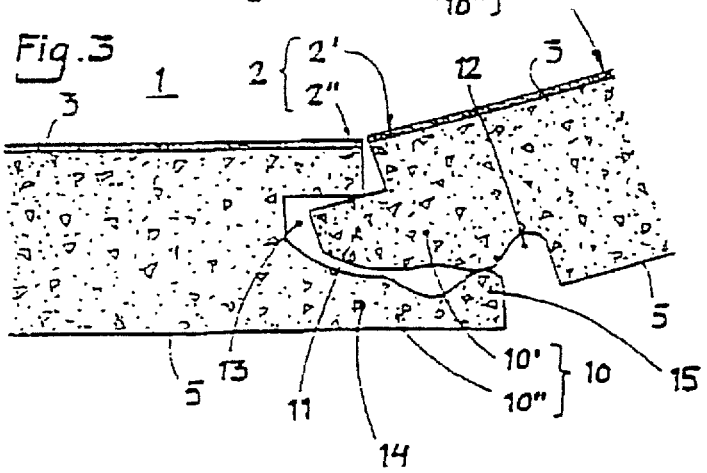
FIG. 3 shows, in cross-section, a third embodiment of a first and a second edge $\mathbf{2}^{I}$ and $\mathbf{2}^{II}$ respectively, during joining.

The embodiment shown in FIG. 3 corresponds mainly with the one shown in FIGS. 1 and 2 above. The lip 15 and lower side 5 groove 12 are, however, provided with a cam 16 and a cam groove 17 which provides a snap action locking.

Figure 4:
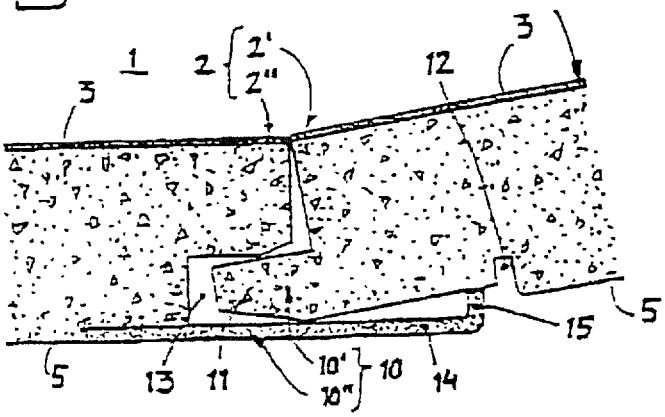
FIG. 4 shows, in cross-section, a fourth embodiment of a first and a second edge $\mathbf{2}^{I}$ and $\mathbf{2}^{II}$ respectively, during joining.

The embodiment shown in FIG. 4 corresponds mainly with the one shown in FIG. 1 above. The lip 15 and cheek 14 is however shaped as a thin resilient section which provides a snap action locking.

Figure 5:
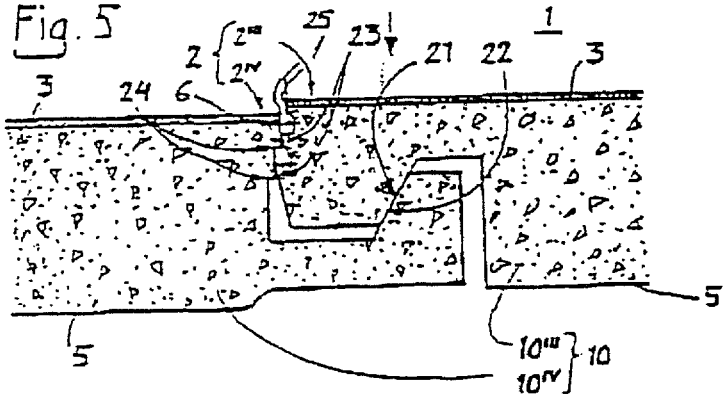
FIG. 5 shows, in cross-section, a third and a fourth edge $\mathbf{2}^{I}$ and $\mathbf{2}^{IV}$ respectively, during joining.

FIG. 5 shows, in cross-section, a third and a fourth edge $2^{II}$ and $2^{IV}$ respectively, of a floor element 1 according to any of the FIGS. 1 to 4. The floor elements 1 are provided with a male vertical assembly joining member $10^{III}$ on a third edge $2^{III}$ while a fourth edge $2^{IV}$ is provided with a female vertical assembly joining member $10^{IV}$. The fourth edge $2^{IV}$ is placed on a side opposite to the third edge $2^{III}$. The male vertical assembly joining members $10^{III}$ are provided with mainly vertical lower cheek surfaces 21 arranged parallel to the closest edge 2. The lower cheek surfaces 21 are intended to interact with mainly vertical upper cheek surfaces 22 arranged on the female vertical assembly joining members $10^{IV}$ so that two joined adjacent floor elements 1 are locked against each other in a horizontal direction. The male vertical assembly joining members $10^{III}$ are moreover provided with two snapping hooks 23 while the female vertical assembly joining members $10^{IV}$ are provided with matching under cuts 24, which by being provided with mainly horizontal locking surfaces limits the vertical movement between two joined adjacent floor elements 1.

The joint between a third and a fourth edge $2^{III}$ and $2^{IV}$ respectively of two joined floor elements 1 further comprises contact surfaces which are constituted by the horizontal locking surfaces of the under cuts 24 and hooks 23, the mainly vertical upper cheek surfaces 22 lower cheek surfaces as well as upper mating surfaces 25. The joint between two joined floor elements 1 also comprises cavities 6.

Figure 6:
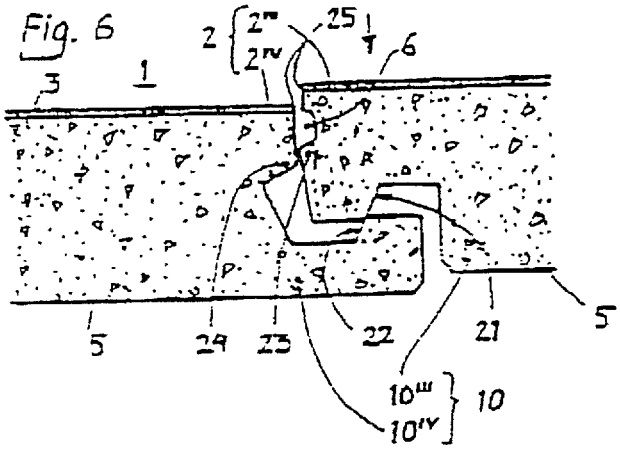
FIG. 6 shows, in cross-section, a second embodiment of a third and a fourth edge $\mathbf{2}^{III}$ and $\mathbf{2}^{IV}$ respectively, during joining.

The embodiment shown in FIG. 6 corresponds in the main with the one shown in FIG. 5. The male vertical assembly joining members $10^{III}$ are, however, provided with only one snapping hook 23 while the female vertical assembly joining members $10^{IV}$ are provided with a matching undercut 24, which by being provided with mainly horizontal locking surfaces limits vertical movement between to joined adjacent floor boards 1.

Figure 7:
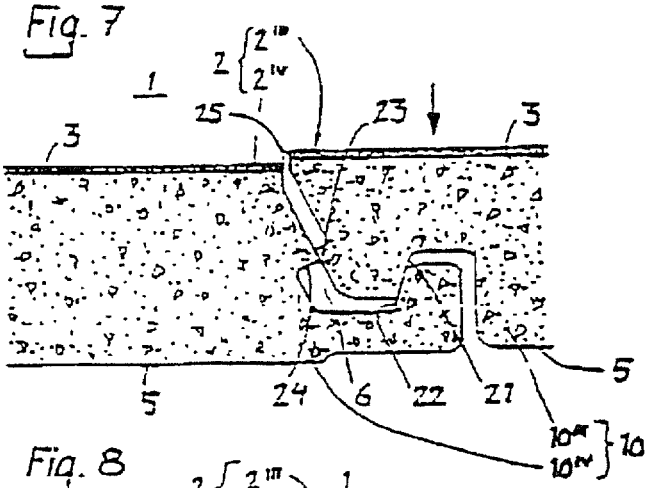
FIG. 7 shows, in cross-section, a third embodiment of a third and a fourth edge $^{2III}$ and $\mathbf{2}^{IV}$ respectively, during joining.

The embodiment shown in FIG. 7 corresponds in the main with the one shown in FIG. 6. The snapping hook 23 on the male vertical assembly joining member $10^{III}$ is, however, moved somewhat inwards in the floor element 1 whereby a guiding angle is formed above the undercut 24 of the female vertical joining member $10^{IV}$.

Figure 8:
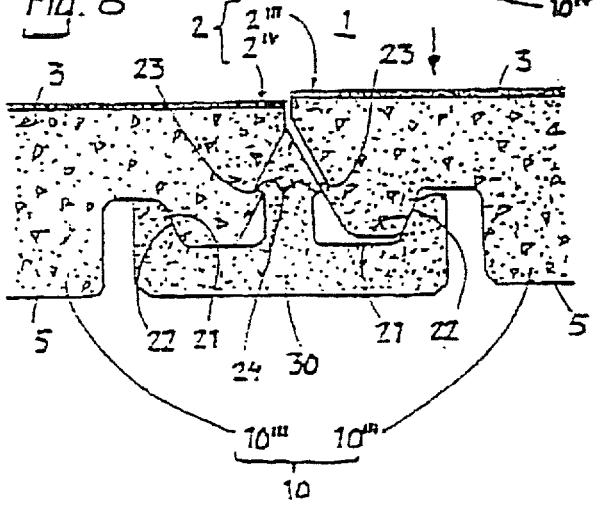
FIG. 8 shows, in cross-section, a fourth embodiment of a third and a fourth edge $\mathbf{2}^{III}$ and $\mathbf{2}^{IV}$ respectively and a vertical assembly joining profile 30, during joining.

The embodiment shown in FIG. 8 corresponds mainly with the one shown in FIG. 7. Both the third and the fourth edges $2^{III}$ and $2^{IV}$ respectively are, however, provided with male vertical assembly joining members $10^{III}$. A vertical assembly joining profile 30, provided with a female vertical assembly joining profile $10^{IV}$ on both sides of a vertical symmetry line, is used for joining the two floor elements 1. The female vertical assembly joining members $10^{IV}$ of the vertical assembly joining profile 30 are equipped similar to the female vertical assembly joining members $10^{IV}$ in FIG. 7 above.

Two adjacent edges 2 of a floor element 1 can at the same time, and in the same turning motion, be joined with a floor element 1 adjacent to the first edge 21 and a floor element 1 adjacent to the third or fourth edge $2^{III}$ and $2^{IV}$ respectively, when assembling floor elements 1 according to the above described embodiments.

The floor elements 1 according to the present invention most often comprises a core. The core is most often comprised of particles or fibre of wood bonded with resin or glue. It is advantageous to coat the surface closest to the joint in cases where the floor will be exposed to high levels of moisture since the cellulose based material is sensitive to moisture. This coating may suitably incorporate resin. wax or some kind of lacquer. It is not necessary to coal the joint when it is to be glued since the glue itself will protect from moisture penetration. The upper decorative layer 3 is constituted of a decorative paper impregnated with melamine-formaldehyde resin. One or more so called overlay sheets of a-cellulose, impregnated with melamine formaldehyde resin may possibly be placed on top of the decorative layer. The abrasion resistance may be improved by sprinkling one or more of the sheets with hard panicles of for example α-aluminium oxide, silicon carbide or silicon oxide. The lower side 5 may suitably be coated with lacquer or a layer of paper and resin.

FIGS. 9-16 demonstrate the improvement of the radially projected dimension of the length (L) of the groove or undercut and the horizontal rotated radially projected height (L) of the lip or upper cheek surface of the boards of the invention. With respect to FIGS. 9-12, the radially projected dimension, indicated at α, corresponds to the length of the groove 13, while β indicates the horizontal rotated length of lip 15. Additionally, γ indicates the length of the tongue 11, while δ is the horizontal rotated length of the locking groove 12. Because α is greater than γ, and β is greater than δ, adjacent floor elements cannot be assembled horizontally. In other words, because tongue 11 (as well as groove 13) is greater than lip 15 (as well as locking groove 12), the floor elements depicted in these figures can only be assembled by rotating or turning one of the floor elements. Generally, in each of these figures, α is substantially equal to γ and β is substantially equal to δ. This "substantially equal" relationship provides for a close fitting, while limiting movement of adjacent panels once assembled. For example, the difference in dimensions may be from 0.005-5%, or from 0.02-0.5 mm.

In contrast, the floor elements shown in FIGS. 13-16 may be assembled through horizontal motion. Specifically, ϵ is the length of the undercut 24, while ζ corresponds to the horizontal rotated length of the upper cheek surface 22. Additionally, η indicates the length of the snapping hooks 23, while the horizontal rotated length of the lower cheek surface 21 is specified by θ.

Because ϵ is less than η and ζ is less than θ, the floor elements can only be assembled through horizontal movement. That is to say, due to the particular dimensions of the undercuts 24, upper cheek surface 22, snapping hooks 23 and lower cheek surface 21, the floor panels of the invention may be joined through substantially vertical movement of one panel with respect to a second panel.

The dimensions ϵ and η may also be related to the thickness of the floor element itself. For example, the ratio between ϵ and the thickness (or η and the surface) may be in the range of about 0.025 to 0.2, typically, about 0.05 to about 0.1, and more typically, about 0.07 to 0.09. That is to say, when the thickness is 8 mm, as is common in conventional boards, ϵ or η would be from 0.2 to 1.5 mm. Additionally, α (or γ) can be at least 2 times greater than β (or δ), while ϵ (or η) is at least 2 times ζ(or θ).

Figure 9:
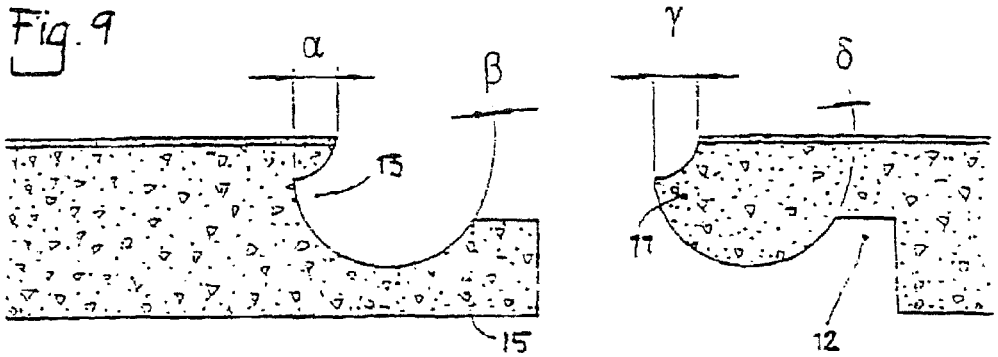
FIG. 9 shows, in cross-section, a first and a second edge $\mathbf{2}^{I}$ and $\mathbf{2}^{II}$ respectively, during joining.
Figure 10:
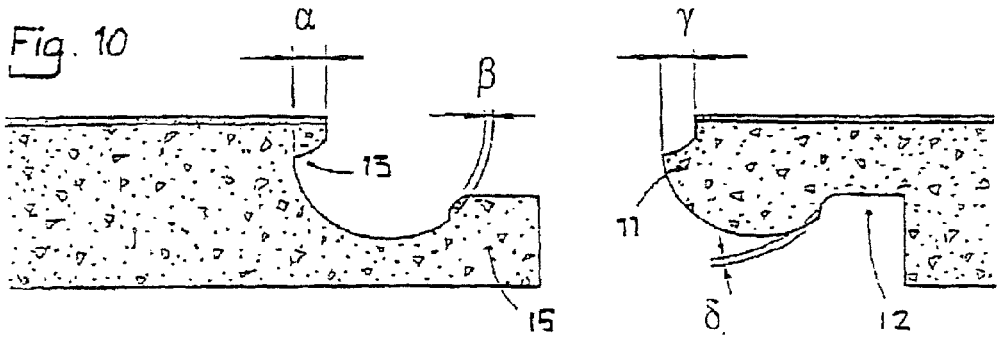
FIG. 10 shows, in cross-section, a second embodiment of a first and a second edge $\mathbf{2}^{I}$ and $\mathbf{2}^{II}$ respectively, during joining.
Figure 11:
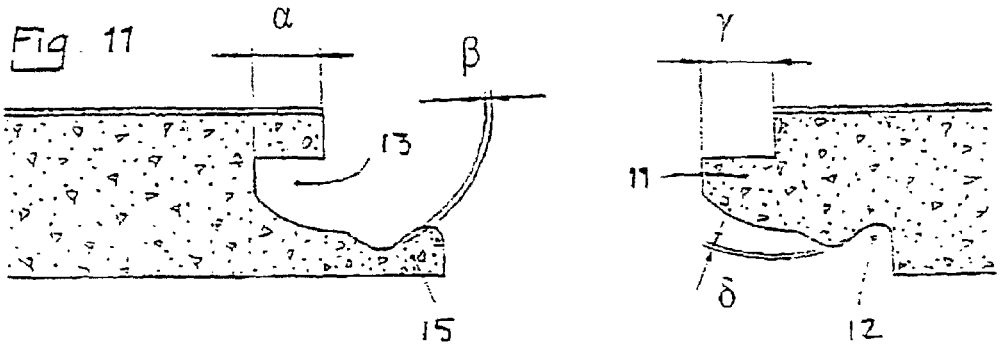
FIG. 11 shows, in cross-section, a third embodiment of a first and a second edge $\mathbf{2}^{I}$ and $\mathbf{2}^{II}$ respectively, during joining.
Figure 12:
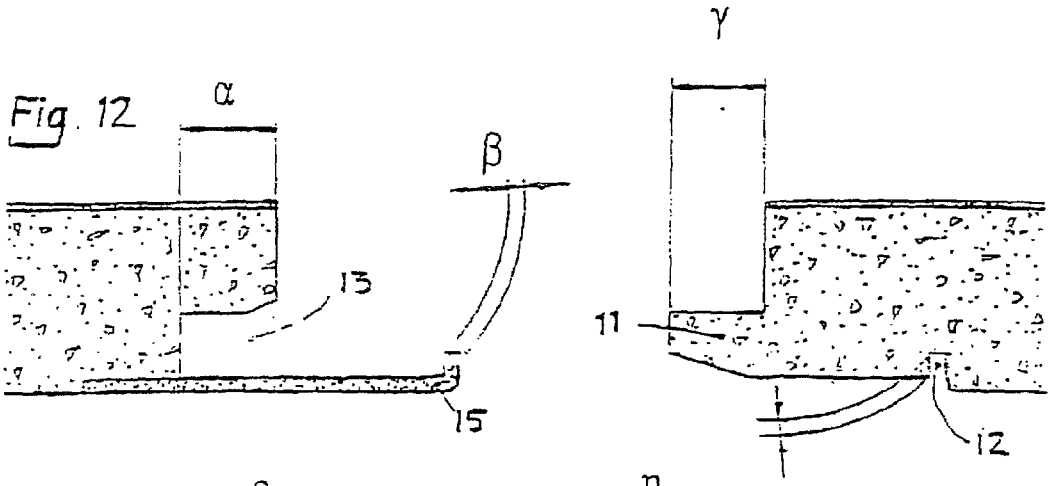
FIG. 12 shows, in cross-section, a fourth embodiment of a first and a second edge $2^{I}$ and $2^{II}$ respectively, during joining.
Figure 13:
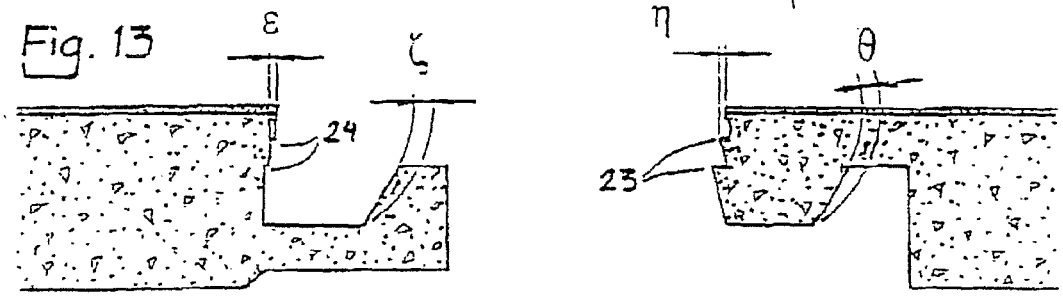
FIG. 13 shows, in cross-section, a third and a fourth edge $2^{III}$ and $2^{IV}$ respectively, during joining.
Figure 14:
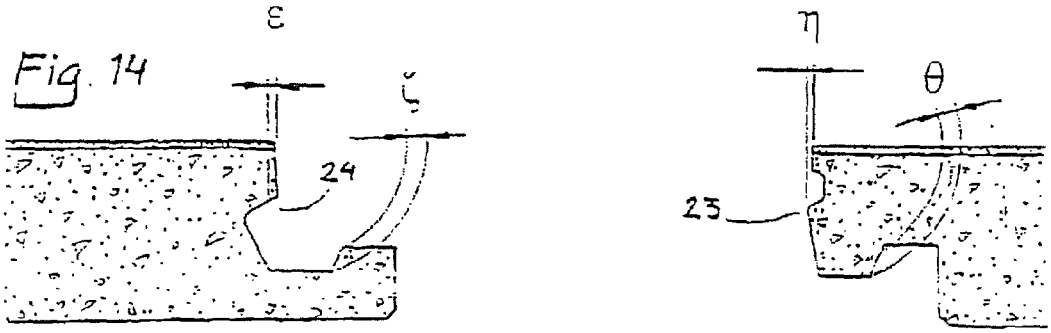
FIG. 14 shows, in cross-section, a second embodiment of a third and a fourth edge $2^{III}$ and $2^{IV}$ respectively, during joining.
Figure 15:
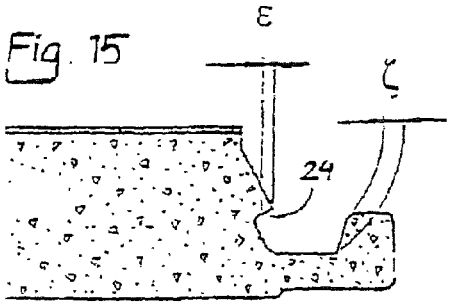
FIG. 15 shows, in cross-section, a third embodiment of a third and a fourth edge $2^{III}$ and $2^{IV}$ respectively, during joining.
Figure 15:
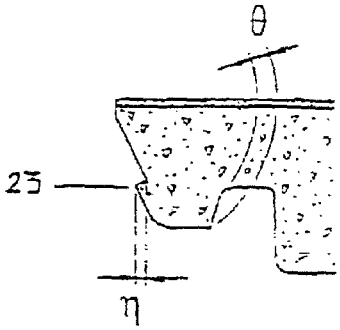
Figure 16:
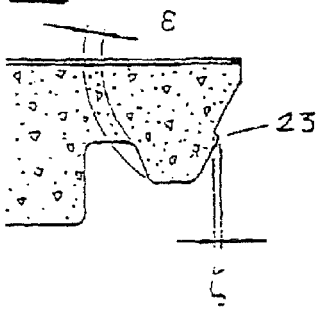
FIG. 16 shows, in cross-section, a fourth embodiment of a third and a fourth edge $2^{III}$ and $2^{IV}$ respectively and a vertical assembly joining profile 30, during joining.
Figure 16:
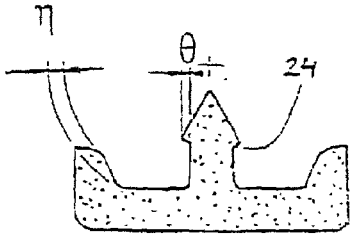

Moreover, all dimension lines of FIGS. 9-16 are intended to indicate the area taken up by the inserted pan as the recesses, such as, the groove 13 and need not be deeper than the tongue 11. Although in some cases, the recesses are deeper than the length of the tongue 11. With particular reference to FIG. 9, β effectively is zero, meaning that there is no undercut when pivoting the panel.

Finally, the floor elements of this invention, preferably, comprise vertically-joined edges on at least two sides. For example, when the floor panel has a substantially rectangular shape, such vertically-joined edges may be found on two, three or all four sides. When the vertically-joined edges are located on less than all sides of the floor element, the remaining sides may include, for example, edges joined by rotating or horizontal movement or simple straight edges without a joining profile.

The invention is not limited by the embodiments shown since they can be varied within the scope if the invention.

The invention claimed is:

1. A surface element designed to be assembled together with similar surface elements to form a plurality of joined surface elements:

the surface element being a floor panel comprising a decorative upper surface, an opposed lower surface and at least four edges disposed between the upper and lower surfaces;

the four edges comprising a first edge and a second edge defining a first pair of opposite sides, and a third edge and a fourth edge defining a second pair of opposite sides;

the four edges including upper edge portions, towards which the surface elements seen from the top visually extend in joined condition;

wherein the first edge of the surface element comprises a first male joining member and the second edge comprises a first female joining member;

the first male joining member comprising a distally extending tongue and the first female joining member comprising a groove which is bordered by an upper lip and a lower lip, said lower lip forming a lower cheek extending in distal direction further than said upper lip;

the first male joining member and the first female joining member being configured such that two of such surface elements can be coupled and vertically as well as horizontally locked at their respective first and second edges;

the vertical locking being realized in that the tongue fits in the groove, said tongue and groove providing a positive vertical locking, said tongue thereto extending with a distal length underneath the upper lip, said length being such that joining of the tongue and groove by means of only a plane-parallel vertical lowering of one surface element in respect to the other is made impossible and as such an explicit lateral insertion of the tongue into the groove is required for joining;

the horizontal locking being realized by an upwardly directed lip at said lower cheek and a lower side groove at the edge comprising the tongue, a highest point of said upward directed lip defining a first horizontal level;

said lower side groove at a distal side thereof being bordered by a lower side protrusion at said tongue, said protrusion having a lowermost portion;

said lowermost portion being located proximally from a vertical plane through the upper edge portion belonging to said first edge; and wherein the third edge of the surface element comprises a second male joining member and the fourth edge comprises a second female joining member;

said second male joining member and second female joining member of the surface element being configured such that two of such surface elements at their respective third edge and fourth edge can be engaged by a downward motion of the third edge of one of said two surface elements with respect to the fourth edge of the other of said two surface elements;

said second male joining member being formed as an upper cheek protruding at said third edge and provided with a downward directed portion;

said second female joining member being formed as a lower cheek protruding at said fourth edge and provided with an upward directed portion, a highest point of the upward directed portion being located in a second horizontal level;

said second male joining member comprising a male cheek surface at a lower side of said upper cheek and said second female joining member comprising a female cheek surface at an upper side of said lower cheek, the male and female cheek surfaces being arranged to interact with one another so that two joined adjacent floor elements become locked to each other in a horizontal direction;

said third and fourth edges each comprising one or more locking surfaces for locking the third edge and a fourth edge of two of such coupled surface elements against vertical separation;

said second horizontal level being located higher than said first horizontal level; and said lower cheek of the second edge being formed in one piece of a core material of the surface element.

2. The surface element of claim 1, wherein also the lower cheek of the fourth edge is formed in one piece of said core material.

3. The surface element of claim 2, wherein the female cheek surface is inclined with respect to the plane of the surface element.

4. The surface element of claim 3, wherein said female cheek surface is upwardly directed from a proximal to a distal position.

5. The surface element of claim 4, wherein said female cheek surface is planar.

6. The surface element of claim 2, wherein said second edge comprises a locking surface which is upwardly directed from a proximal to a distal position.

7. The surface element of claim 6, wherein said locking surface is planar.

8. The surface element of claim 2, wherein said upper cheek, inclusive said one or more locking surfaces for locking the third edge and a fourth edge of two of such coupled surface elements against vertical separation are formed in one piece of said core material.

9. The surface element of claim 2, wherein the lower cheek of said fourth edge has a distal outer edge, said outer edge being free from any vertically active locking portions.

10. The surface element of claim 9, wherein in coupled condition a space exists between said distal outer edge and an opposed portion of the third edge of the coupled surface element.

11. The surface element of claim 1, wherein the first male joining member and the first female joining member are configured such that said explicit lateral insertion of the tongue into the groove requires that the tongue is inserted into the groove in an inclined manner, by presenting the surface element having the tongue in a tilted position, followed by a turning down of the surface element comprising the tongue.

* * * * *